US007520240B2

(12) United States Patent
Tufte

(10) Patent No.: US 7,520,240 B2
(45) Date of Patent: Apr. 21, 2009

(54) COVER SYSTEM FOR A BOAT

(76) Inventor: Brian N. Tufte, 17488 Wexford Dr., Eden Prairie, MN (US) 55347

( * ) Notice: Subject to any disclaimer, the term of this patent is extended or adjusted under 35 U.S.C. 154(b) by 85 days.

(21) Appl. No.: 10/905,818

(22) Filed: Jan. 21, 2005

(65) Prior Publication Data

US 2006/0162640 A1 Jul. 27, 2006

(51) Int. Cl.
*B63B 17/00* (2006.01)

(52) U.S. Cl. ..... 114/361

(58) Field of Classification Search ..... 114/361; 296/99.1, 100.11, 100.12, 100.14, 107.13, 296/107.14, 107.18, 136.1, 136.12
See application file for complete search history.

(56) References Cited

U.S. PATENT DOCUMENTS

| | | | | | |
|---|---|---|---|---|---|
| 245,651 | A | | 8/1881 | Meech | |
| 600,272 | A | * | 3/1898 | Seymour | 114/361 |
| 869,399 | A | * | 10/1907 | Walter | 114/361 |
| 2,493,833 | A | | 1/1950 | Reynolds | |
| 2,570,911 | A | | 10/1951 | Birdlebough | |
| 2,947,277 | A | | 8/1960 | Stevens | |
| 3,083,540 | A | | 4/1963 | Smith | |
| 3,160,436 | A | * | 12/1964 | Duddleston | 296/105 |
| 3,179,959 | A | | 4/1965 | McDougall | |
| 3,195,549 | A | | 7/1965 | Stevens | |
| 3,312,990 | A | * | 4/1967 | Lapworth | 114/361 |
| 3,370,308 | A | | 2/1968 | Krenzler | |
| 3,434,166 | A | | 3/1969 | Clymer | |
| 3,572,353 | A | | 3/1971 | Pinkley | |
| 3,805,724 | A | * | 4/1974 | Butler | 114/71 |
| 3,942,830 | A | * | 3/1976 | Woodard | 296/105 |
| 3,955,228 | A | | 5/1976 | Gaschenko et al. | |
| 4,019,212 | A | | 4/1977 | Downer | |
| 4,223,414 | A | | 9/1980 | Dickson | |
| 4,641,600 | A | | 2/1987 | Halvorsen | |
| 4,926,782 | A | | 5/1990 | Lacy | |
| 4,979,456 | A | | 12/1990 | Steward | |
| 5,009,184 | A | | 4/1991 | Voldrich | |
| 5,016,558 | A | * | 5/1991 | Oehler | 114/361 |

(Continued)

FOREIGN PATENT DOCUMENTS

| | | |
|---|---|---|
| DE | 29508245 | 8/1995 |

(Continued)

OTHER PUBLICATIONS

Floe, "Aluminum PWC, Boat & Pontoon Lift Systems," Floe International, Inc., 12 pages, 2005.

(Continued)

*Primary Examiner*—Lars A Olson
(74) *Attorney, Agent, or Firm*—Brian N. Tufte

(57) ABSTRACT

A boat cover system that can provide some level of protection to the interior of the boat when the boat is not in use, and can also provide some level of protection to the occupants of the boat when the boat is in use. The cover system may include a cover assembly that includes a support frame and a cover, where the support frame supports the cover. One or more cover supports may be provided for supporting the cover assembly. The one or more cover supports may be adapted to allow the cover assembly to be moved between a raised position and a lowered position.

29 Claims, 17 Drawing Sheets

U.S. PATENT DOCUMENTS

| | | | | |
|---|---|---|---|---|
| 5,044,298 | A * | 9/1991 | Pepper et al. | 114/361 |
| 5,058,946 | A * | 10/1991 | Faber | 296/186.4 |
| 5,303,667 | A | 4/1994 | Zirkelback et al. | |
| 5,458,079 | A | 10/1995 | Matthews et al. | |
| 5,479,872 | A | 1/1996 | Hulett | |
| 5,706,752 | A | 1/1998 | Menne, Jr. et al. | |
| 5,769,105 | A | 6/1998 | Margol et al. | |
| 5,803,104 | A | 9/1998 | Pollen | |
| 5,850,799 | A | 12/1998 | Geisel et al. | |
| 5,894,812 | A | 4/1999 | Dessingue | |
| 5,901,657 | A | 5/1999 | Schwartz | |
| 5,909,921 | A * | 6/1999 | Nesbeth | 296/100.1 |
| 5,983,824 | A | 11/1999 | Hernandez | |
| 6,102,059 | A | 8/2000 | Miller | |
| 6,158,377 | A | 12/2000 | Szukhent, Jr. | |
| 6,209,477 | B1 | 4/2001 | Biedenweg | |
| 6,260,505 | B1 | 7/2001 | Polidan | |
| 6,439,150 | B1 | 8/2002 | Murphy et al. | |
| 6,443,090 | B1 | 9/2002 | Giffin et al. | |
| 6,447,038 | B1 | 9/2002 | Davis et al. | |
| 6,659,035 | B2 | 12/2003 | Treytiak | |
| 6,666,163 | B2 | 12/2003 | Pastor et al. | |
| 6,688,252 | B1 | 2/2004 | Caravella | |
| 6,786,171 | B1 | 9/2004 | Elbers | |
| 6,820,569 | B2 | 11/2004 | Warfel et al. | |
| 6,983,716 | B1 | 1/2006 | Ankney et al. | |
| 7,051,669 | B2 | 5/2006 | Warfel et al. | |
| 7,216,604 | B2 | 5/2007 | Finney et al. | |
| 7,370,597 | B1 | 5/2008 | Schwindaman | |
| 7,412,940 | B2 | 8/2008 | Kemmer et al. | |
| 2003/0127037 | A1 | 7/2003 | Himmel | |
| 2003/0217683 | A1 * | 11/2003 | Heckman | 114/361 |
| 2004/0070516 | A1 | 4/2004 | Nielsen | |
| 2006/0231010 | A1 | 10/2006 | Baylor | |
| 2008/0011217 | A1 | 1/2008 | Russikoff | |

FOREIGN PATENT DOCUMENTS

| | | |
|---|---|---|
| GB | 2275450 | 8/1994 |
| GB | 2392881 | 3/2004 |

OTHER PUBLICATIONS

Sea-Legs, "The Pontoon Lift That Goes Where You Go," 4 pages, 2005.

http://www.custompontoonboatkitsetc.com, "Custom Pontoon Boat Kits etc.", 7 pages, printed Feb. 1, 2005.

http://www.hilltopboat.com, "Boat Covers—Pontoon—0279-1551 Pontoon w Fold Down Hard Top 14'6"×a02"-0279", 2 pages, printed Feb. 1, 2005.

http://www.taylormarine.com/press_releases/pressarchive.php, Capabilities—Archived Press Releases, Taylor Made Systems, Taylor Made Systems unveils Power Convertible Top, 2 pages, printed Mar. 3, 2006.

http://www.taylormarine.com/press_releases/pressarchive.php, Capabilities—Archived Press Releases, Taylor Made Systems, Taylor Made Power Power Convertible Top Featured At IBEX, 2 pages, printed Mar. 3, 3006.

* cited by examiner

COVER SYSTEM FOR A BOAT

FIELD

The present invention relates to boats, and more particularly, to cover systems for boats.

BACKGROUND

Many forms of boat covers are known, some of which are simple, make-shift canvas or like covers sometimes of the button-on, button-off type. Such boat covers are typically manually installed by the user of the boat, and provide some level of protection to the interior of the boat while the boat is not in use.

When in use, some boats include a sun shade cover, often called a bimini top or the like, that provides some level of protection to the occupants of the boat from the sun. In many cases, a fabric cover is mounted on a tubular aluminum framework, which can be either fixed on the boat for convertible movement and/or pivoted between a shade providing position and a folded non-shade providing position. In the shade providing position, the sun shade cover is often suspended above the interior of the boat with open sides so that the occupants can move about and interior of the boat and see laterally out of the sides of the boat. In the folded non-shade providing position, the fabric cover is typically wrapped around the tubular aluminum framework, and the entire structure is pivoted out of the way to one side of the boat, typically towards the rear of the boat.

What would be desirable is a boat cover that can provide some level of protection to the interior of the boat when the boat is not in use, and can also provide some level of protection to the occupants of the boat from the sun and/or other elements when the boat is in use.

SUMMARY

The following summary is provided to facilitate an understanding of some of the innovative features unique to the present invention and is not intended to be a full description. A full appreciation of the invention can be gained by taking the entire specification, claims, drawings, and abstract as a whole.

The present invention relates to a boat cover system that may provide some level of protection to the interior of the boat when the boat is not in use, and also some level of protection to the occupants of the boat from the sun, rain and/or other elements when the boat is in use. In some illustrative embodiments, the boat cover system includes a cover assembly that can be moved between a raised position and a lowered position, wherein in the lowered position, the cover assembly provides some level of protection to the interior of the boat when the boat is not in use, and in the raised position, the cover assembly provides some level of protection to the occupants of the boat from the sun, rain and/or other elements when the boat is in use.

In some embodiments, the boat cover system may be used in conjunction with a boat that includes a platform (e.g. floor), with side walls extending up from the platform around a perimeter of a protected area. The cover assembly may include a support frame and a cover, wherein the support frame supports the cover. One or more cover supports may be provided for supporting the cover assembly above the platform. In addition, the one or more cover supports may be adapted to allow the cover assembly to be moved between a raised position and a lowered position. In the lowered position, a perimeter of the cover assembly may extend laterally out to at least the side walls of the boat to provide a cover for all or substantially all of the desired protected area. In some cases, the perimeter of the cover assembly may extend laterally out past the side walls of the boat, and in some cases, overlap in a vertical direction a top portion of the one or more side walls, but this is not required in all embodiments. In the raised position, the cover assembly may provide shade to occupants in at least part of the protected area from the sun or the like. In the lowered position, the cover assembly may cover and help prevent sun, rain, debris and/or other elements or objects from entering the protected area of the boat when the boat is not in use.

It is contemplated that the cover assembly may be moved between the lowered position and the raised position in any number of ways. In some cases, the cover assembly can be moved between the lowered position and the raised position under human power. A crank, a wench, simply pushing and/or pulling the cover assembly, and/or using any other suitable human powered moving mechanism or method may be employed. Springs or compressed cylinders may be provided to assist in the raising and/or lowering of the cover assembly, if desired. In other cases, the cover assembly can be moved between the lowered position and the raised position using a powered system, such as a motor or pump. When a motor or pump is used, motion and/or energy from the motor or pump may be transferred to move the cover assembly using one or more belts, cables, screw drives, shafts, hydraulic cylinders, pulleys, gears, tubes and/or any other suitable system or method, as desired.

In some cases, the support frame of the cover assembly may include an extended configuration and a retracted configuration, wherein the cover assembly can be selectively changed from the extended configuration to the retracted configuration. In the retracted position, the cover assembly may cover less of the interior of the boat, which may be particularly desirable when the cover assembly is in the raised position, but this is not required in all embodiments. In the extended configuration, the cover assembly may cover more of the interior of the boat, which may be particularly desirable when the cover assembly is in the lowered position and adapted to protect all or substantially all of a protected area of the boat.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION

Figure 1:
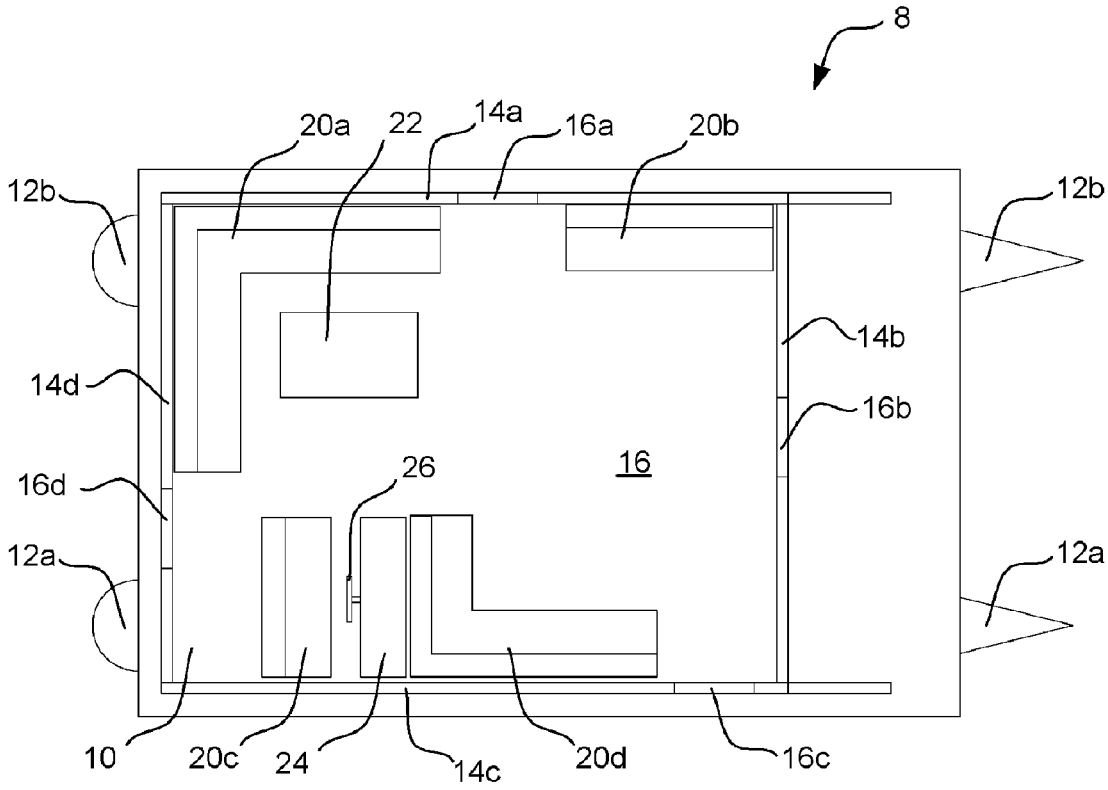
FIG. 1 is a schematic top view of an illustrative pontoon boat.

The following description should be read with reference to the drawings wherein like reference numerals indicate like elements throughout the several views. The detailed description and drawings show several illustrative embodiments which are meant to be illustrative of the present invention.

For illustration purposes, a pontoon boat is used as an example in the Figures and examples provided below. It is contemplated, however, that the present invention may be used in conjunction with any type of boat including recreational speed type boats, fishing boats of all sizes, cruisers, and/or any other type of boat, as desired.

FIG. 1 is a schematic top view of an illustrative pontoon boat. The illustrative pontoon boat is generally shown at 8, and includes a platform 10 that is positioned above and attached to two (or more) spaced pontoon floats 12*a* and 12*b*. The spaced pontoon floats 12*a* and 12*b* provide floatation for the pontoon boat 8.

One or more side walls, such as side walls 14*a*-14*d*, may extend up from the platform 10 around a perimeter of a protected area 16. In the illustrative embodiment, the protected area 16 is defined by the side walls 14*a*-14*d*. In some cases, some or all of the side walls 14*a*-14*d* may include a door, such as doors 16*a*-16*d*. The doors 16*a*-16*d* may help provide access to/from the protected area 16 of the pontoon boat 8.

One or more seats, tables, sinks, bathrooms, control consoles, wet bars or the like may be provide in the protected area. In the illustrative embodiment, seats 20*a*-20*d*, a table 22 and a control console 24 including a steering wheel 26 are provided in the protected area 16. These, however, are only illustrative. The protected area may also be carpeted in some cases.

In many cases, it is desirable to cover the protected area to help prevent sun, rain, debris and/or other elements or objects from entering the protected area of the pontoon boat 8 when the pontoon boat 8 is not in use. If the protected area is not covered, the sun may cause the seats 20*a*-20*d*, table 22, control console 24 and carpet to deteriorate faster. Also, rain may cause the seats 20*a*-20*d* and other objects in the protected area 16 to become wet, which may be uncomfortable to the users of the boat when the boat is eventually used. Dust, dirt, debris, seedlings and other objects may also enter the protected area 16, which may require extensive cleaning by the boat user prior to its use.

As such, it is often desirable to cover the protected area when the boat is not in use. Currently, this is typically done by manually fitting a tarp or the like over the protected area and securing the edges of the tarp to the side walls. One or more support poles are sometimes manually positioned between the platform 10 and the middle of the tarp to help prevent sagging of the tarp, which if not addressed, can collect water. The process of manually fitting the tarp over the protected area after each boat use, and removing and storing the tarp prior to each boat use, can be a fairly laborious and tedious task. This sometimes causes the boat user to not use the pontoon boat 18 as much as he/she would like, particularly for shorter excursions or outings.

Figure 2A:
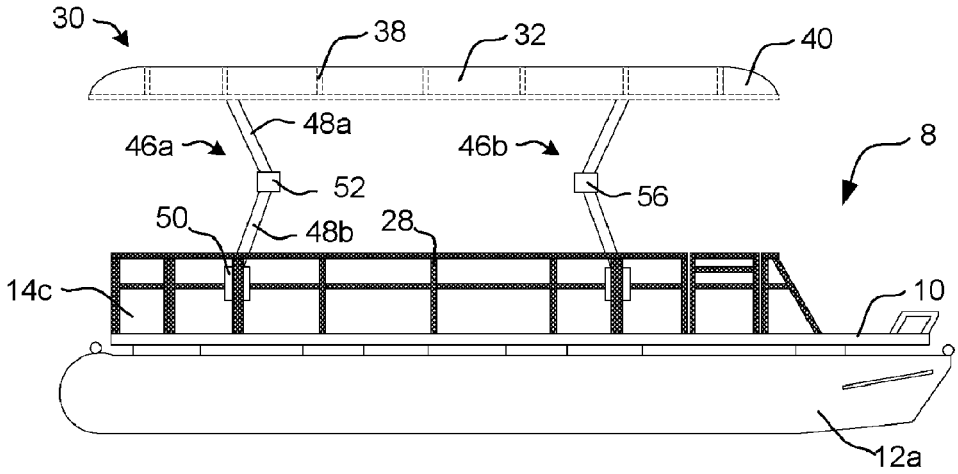
FIG. 2A is a schematic side view of a pontoon boat, with a cover assembly in a raised position.
Figure 2B:
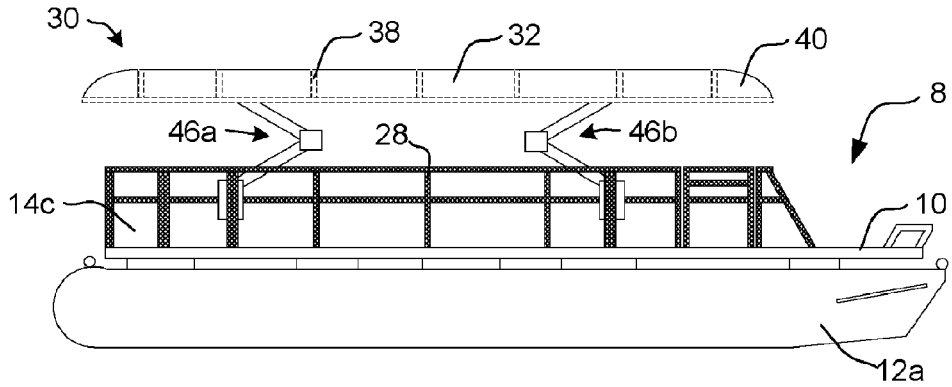
FIG. 2B is a schematic side view of the pontoon boat of FIG. 2A, with the cover assembly in an intermediate position.
Figure 2C:
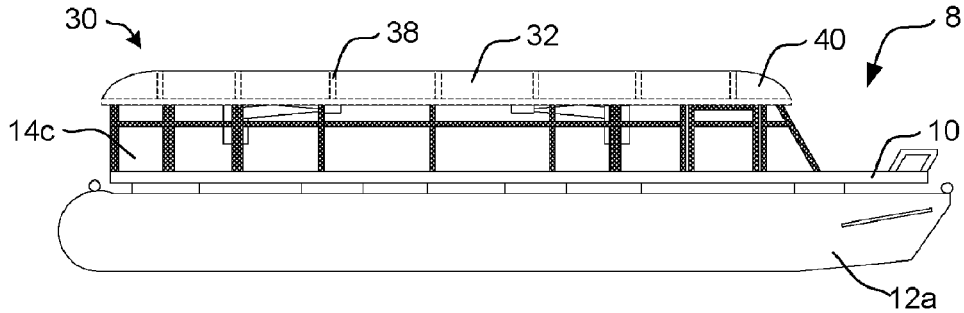
FIG. 2C is a schematic side view of the pontoon boat of FIG. 2A, with the cover assembly in a lowered position.

FIG. 2A-2C are schematic side view drawings of the pontoon boat 8 of FIG. 1, fitted with a boat cover system 30 in accordance with one illustrative embodiment of the present invention. In the illustrative embodiment, the side walls 14*a*-14*d* extend up from the platform and include one or more support members, such as support member 28. In some cases, one or more panels may be fixed to the support members to provide a wall like structure around the perimeter of the protected area 16. The one or more panels may help prevent sun, rain, and debris from entering the protected area through the side walls 14*a*-14*d*.

The illustrative boat cover system 30 may include a cover assembly 32 that can be moved between a raised position (see FIG. 2A) and a lowered position (see FIG. 2C). In the illustrative embodiment, the cover assembly 32 includes a support frame 38 and a cover 40, wherein the support frame 38 supports the cover 40. Also, four cover supports may be provided for supporting the cover assembly 32 above the platform 10. Only the starboard side cover supports 46*a* and 46*b* are shown in FIGS. 2A-2C. In some cases, the cover 40 may be a flexible material such as canvas, flexible plastic, or any other suitable flexible material. In other cases, the cover 40 may be a rigid material, such as fiberglass, metal or any other suitable rigid material. When the cover 40 is a rigid material, the support frame 38 may not need to be as extensive as when a flexible material is used, and in some cases, the support frame 28 may not be provided at all.

In the raised position, the cover assembly 30 provides some level of protection to the occupants of the pontoon boat 8 from sun, rain and/or other elements when the boat is in use. The cover assembly 30 may be positioned sufficiently far above the platform 10 so that people can walk under the cover assembly 30 without bending over. In the lowered position (see FIG. 2C), the cover assembly 32 may provide protection to the interior of the pontoon boat 8 in the protected area 16.

In some embodiments, the cover supports 46*a* and 46*b* may be adapted to allow the cover assembly 30 to be moved between the raised position (see FIG. 2A) and the lowered position (see FIG. 2C). In the illustrative embodiment, each cover support includes an upper leg and a lower leg. For example, cover support 46*a* includes an upper leg 48*a* and a lower leg 48*b*. In one illustrative embodiment, the lower end of the lower leg 48*b* may be pivotally connected to the side wall (or platform) as shown at 50, the upper end of the lower leg 48*b* may be pivotally connected to the lower end of the upper leg 48*a* as shown at 52, and the upper end of the upper leg 48*a* may be pivotally connected to the cover assembly 30. In the illustrative embodiment, when the cover assembly 30 is lowered, the pivotal connection 52 between the lower leg 48*b* and the upper leg 48*a* of the cover support 46*a* moves toward the bow, and the pivotal connection 56 between the lower leg and the upper leg of the cover support 46*b* moves toward the stern (i.e. in opposite directions), however, this is not required in all embodiments.

In some cases, a bias may be applied via the cover supports 46*a* and 46*b* that biases the cover assembly 30 against gravity. The bias may be provided by one or more springs, rubber straps, compressed cylinders, or any other suitable bias providing element(s). The bias may make it easier to move the cover assembly 30 between the lowered position and the raised position, if desired. A bias may be provided, but it is not required.

In some cases, the cover assembly 30 can be moved between the lowered position and the raised position under human power. A crank, a wench, or simply pushing and/or pulling the cover assembly 30, and/or any other suitable human powered moving mechanism or method may be employed. In other cases, the cover assembly 30 can be moved between the lowered position and the raised position using a powered system, such as a motor or pump. When a motor or pump is used, and in the illustrative embodiment, motion and/or energy from the motor or pump may be transferred to rotate the lower legs of the cover supports 46*a* and 46*b* in opposite directions to move the cover assembly 30 between the lowered and raised positions. Any number of methods may be used to transfer the motion and/or energy from the motor or pump to the lower legs of the cover supports 46*a* and 46*b* including via one or more belts, cables, screw drives, shafts, tracks, hydraulic cylinders, hydraulic tubes, pulleys, gears, and/or any other suitable system or method, as desired.

FIG. 2A is a schematic side view of the pontoon boat 8, with the cover assembly 30 in the raised position. FIG. 2B is a schematic side view of the pontoon boat 8, with the cover assembly 30 in an intermediate position, and FIG. 2C is a schematic side view of the pontoon boat 8, with the cover assembly 30 in the lowered position.

In some embodiments, and in the lowered position, a perimeter of the cover assembly 30 may extend laterally out to at least the side walls 14*a*-14*d* of the pontoon boat 8 (see FIG. 3) to provide a cover for all or substantially all of the protected area 16. In some cases, the perimeter of the cover assembly 30 may extend laterally out past the side walls 14*a*-14*d* of the pontoon boat 8, and in some cases, overlaps in a downward vertical direction over a top portion of the side walls 14*a*-14*d* (see FIG. 2C and FIG. 4), but this is not required in all embodiments. Such a vertical overlap may, in some cases, provide better protection to the protected area 16 of the pontoon boat 8 from wind swept rain, blowing dirt, dust, debris, etc.

Figure 3:
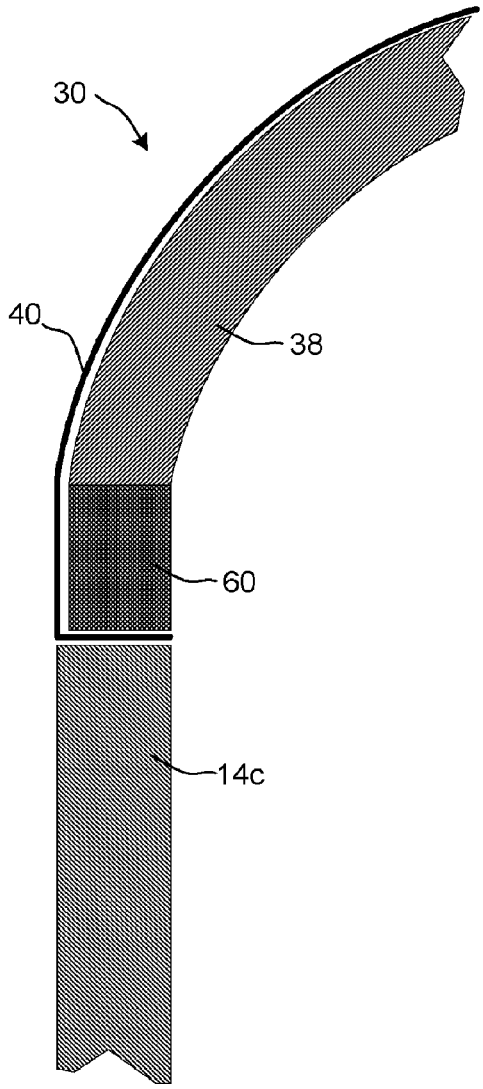
FIG. 3 is a schematic cross-sectional side view of a cover system that extends to the side wall of a boat.

FIG. 3 is a schematic cross-sectional exploded side view of a cover system 30 that extends to the side walls (e.g. side wall 14*c*) of a pontoon boat 8. As can be seen, the illustrative cover system 30 includes a support frame 38 and a cover 40, wherein the support frame 38 supports the cover 40. In this illustrative embodiment shown in FIG. 3, the cover system 30 is sized such that the perimeter of the cover system 30 extends and is roughly aligned with the side walls (e.g. side wall 14*c*) of the pontoon boat 8. In some cases, the support frame 38 includes a lower support member 60 that extends around the perimeter of the support frame 38, and rests on the top of the side walls (e.g. side wall 14*c*) when the cover assembly 30 is in the lowered position. In this configuration, rain or the like falling on the cover system 30 tends to run off the cover system 30 and down the outside of the side walls 14*c*, thereby providing protection to the protected area 16 of the pontoon boat 8.

Figure 4:
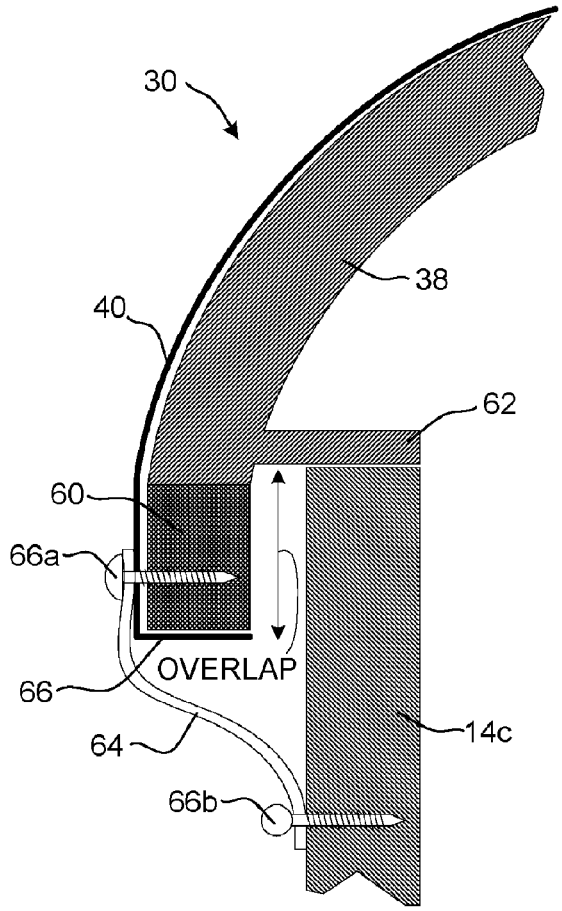
FIG. 4 is a schematic cross-sectional side view of a cover system that extends out laterally past the side walls of a boat, and overlaps the side wall in a vertical direction.

FIG. 4 is a schematic cross-sectional exploded side view of a cover system 30 that extends out laterally past the side walls (e.g. side wall 14*c*) of the pontoon boat 8, and overlaps the top of the side wall 14*c* in a vertical direction as shown. In some embodiments, the support frame 38 may include one or more resting supports 62 that are elevated above the lower edge 66 of the support frame 38 and extend inward from the perimeter of the support frame 38. These resting supports 62 may rest on the top of the side walls (e.g. side wall 14*c*) to support the cover assembly 30 when the cover assembly 30 is in the lowered position. Such a vertical overlap may, in some cases, provide better protection to the protected area 16 of the pontoon boat 8 from wind swept rain, blowing dirt, dust, debris, etc.

FIG. 4 also shows a safety strap 64 that may be selectively attached between the support frame 38 and the side wall (e.g. side wall 14*c*). The safety strap 64 may help ensure that the cover assembly 30 does not significantly rise up from the lowered position during high wind or other conditions. The safety strap 64 may be particularly useful when, for example, the pontoon boat 8 is being transported by trailer, where high wind conditions are expected. Also, safety strap 64 may provide a measure of safety during storms or the like. In some embodiments, multiple safety straps may be provided around the perimeter of the cover assembly 30 to help keep the cover assembly 30 in the lowered position. While a safety strap 64 is only shown in FIG. 4, it is contemplated that a safety strap may also be used in conjunction with the illustrative embodiment shown in FIG. 3, as well as other embodiments, as desired. Also, rather than a safety strap 64, a latch or the like may be used. While a safety strap 64 is shown in FIG. 4, it is contemplated that any suitable mechanism may be used to help secure the cover assembly 30 relative to the side walls (e.g. side wall 14*c*), as desired.

Figure 5A:
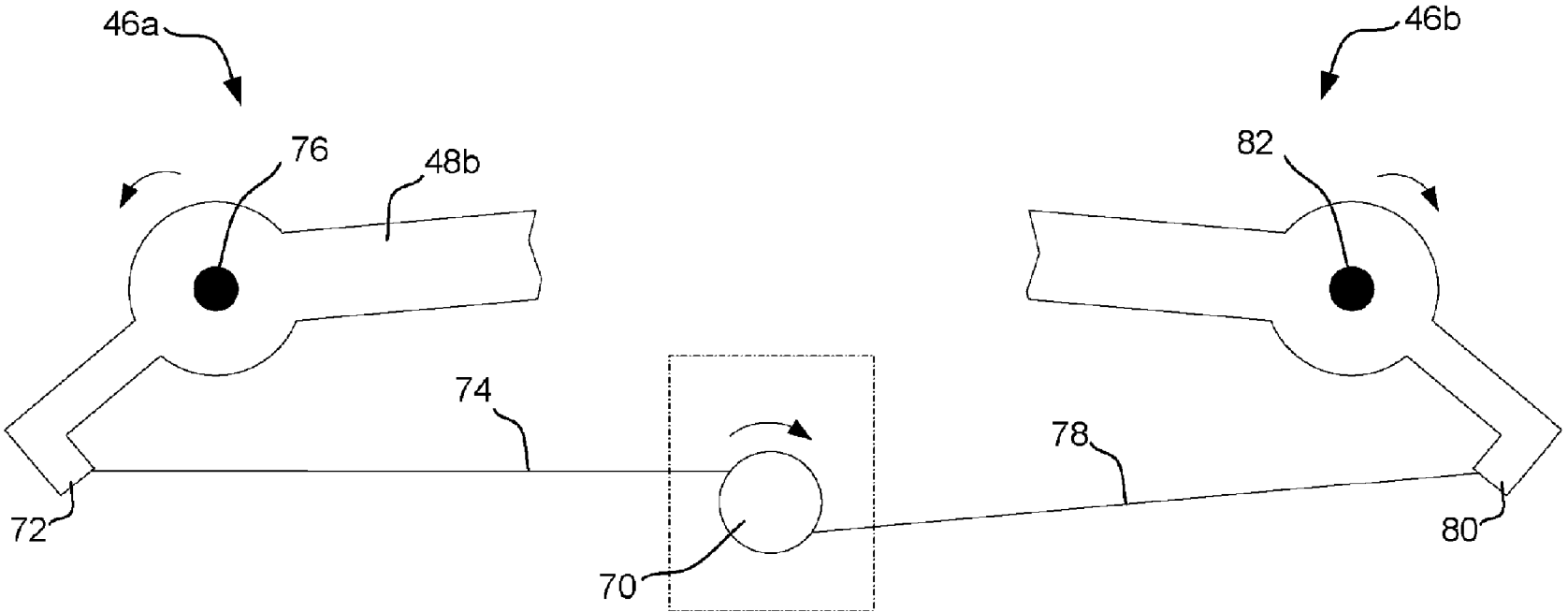
FIG. 5A is a schematic side view of one illustrative drive mechanism for the cover assembly of FIG. 2A-2C, with the cover system in the lowered position.

FIG. 5A is a schematic side view of one illustrative drive mechanism for the cover assembly 30 of FIG. 2A-2C, with the cover system 30 in the lowered position. The illustrative drive mechanism includes a rotating shaft 70 that is driven by a motor or the like. A first cable 74 is attached to a lower connecting arm 72 of the lower arm 48*b* of the cover support 46*a* (see FIG. 2A), and is wrapped around the rotating shaft 70 in a first direction. The lower arm 48*b* of the cover support 46*a* pivots about a pivot point 76, as shown. Likewise, a second cable 78 is attached to a lower connecting arm 80 of the lower arm of the cover support 46*b* (see FIG. 2A), and is wrapped around the rotating shaft 70 in a second direction, as shown. The lower arm of the cover support 46*b* pivots about a pivot point 82, as shown.

Figure 5B:
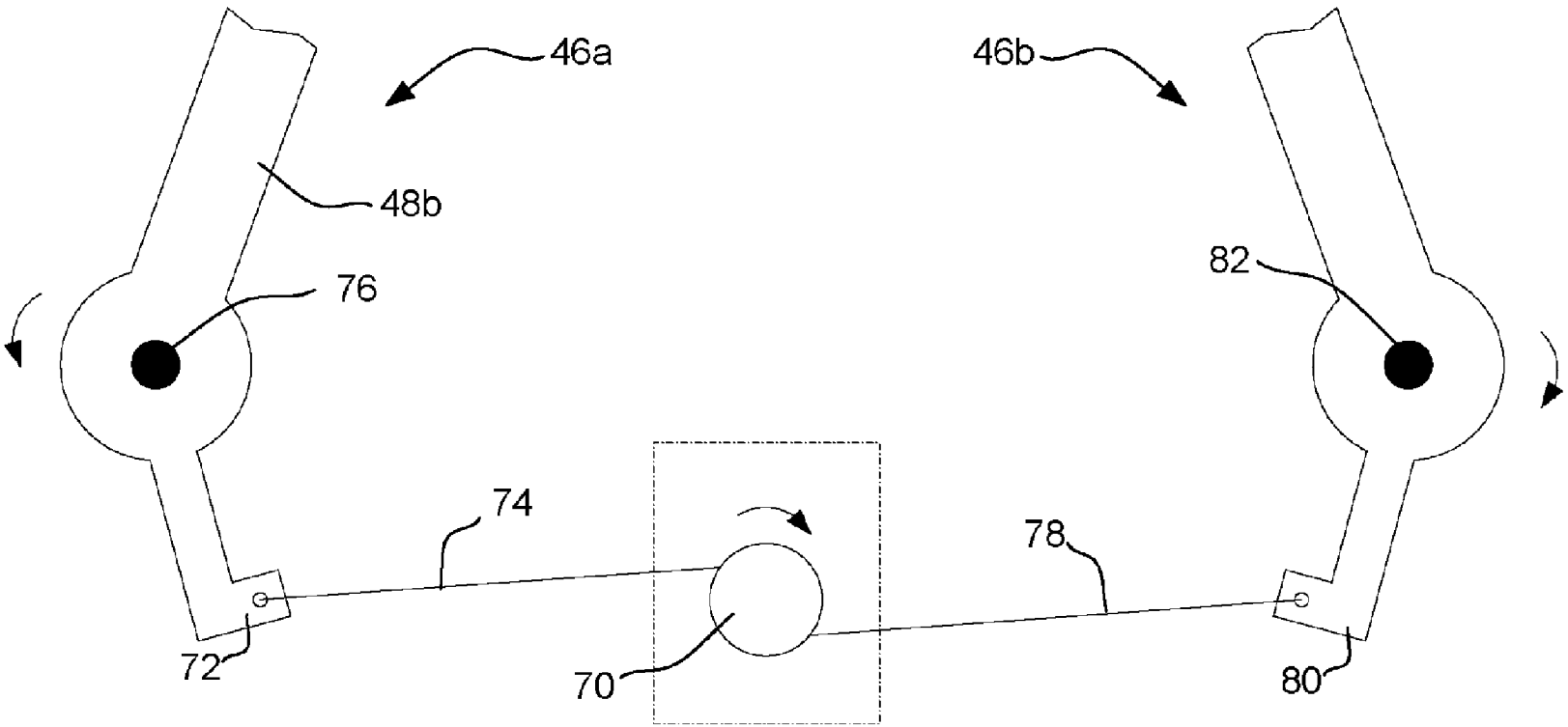
FIG. 5B is a schematic side view of the illustrative drive mechanism of FIG. 5A, with the cover system in the raised position.

To raise the cover assembly 30 of FIG. 2C, the rotating shaft 70 is rotated in a clockwise direction, as shown in FIG. 5B. With reference to FIG. 5B, such rotation causes the rotating shaft 70 to wind up and shorten the first cable 74 and the second cable 78, which pulls the lower connecting arm 72 and the lower connecting arm 80 toward each other. This causes the lower arm 48*b* of the cover support 46*a* to rotate in a counter-clockwise direction about the pivot point 76, and the lower arm of the cover support 46*b* to rotate in a clock-wise direction about the pivot point 82. This, in turn, causes the cover assembly 30 to move from the lowered position to the raised position, as best shown in FIGS. 2A-2C. To move the cover assembly 30 from the raised position to the lowered, the rotating shaft 70 is rotated in the opposite direction.

In some cases, a bias may be applied to bias the cover assembly 30 against gravity. The bias may be provided by one or more springs, rubber straps, compressed cylinders, or any other suitable bias providing element(s). The bias may make it easier to move the cover assembly 30 between the lowered position and the raised position, if desired. Providing such a bias may help reduce the power and cost of the components used to move the cover assembly 30 between the lowered position and the raised position. For example, the size, power and cost of any motor (not shown) that is used to drive the rotating shaft 70 of FIG. 5A may be reduced if a bias is applied to at least partially bias the cover assembly 30 against gravity.

Figure 6A:
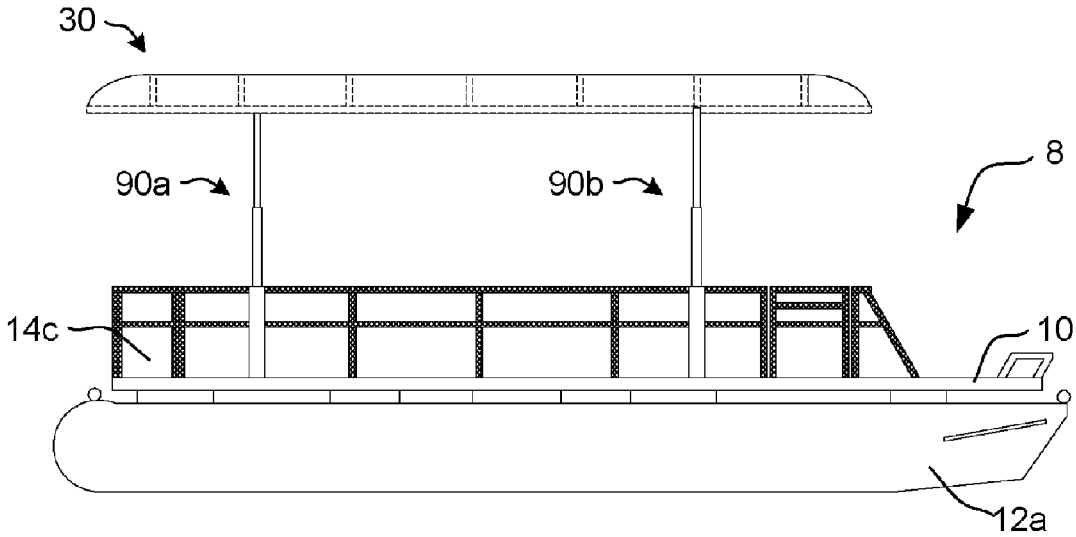
FIG. 6A is a schematic side view of another illustrative pontoon boat, with a cover assembly in a raised position.
Figure 6B:
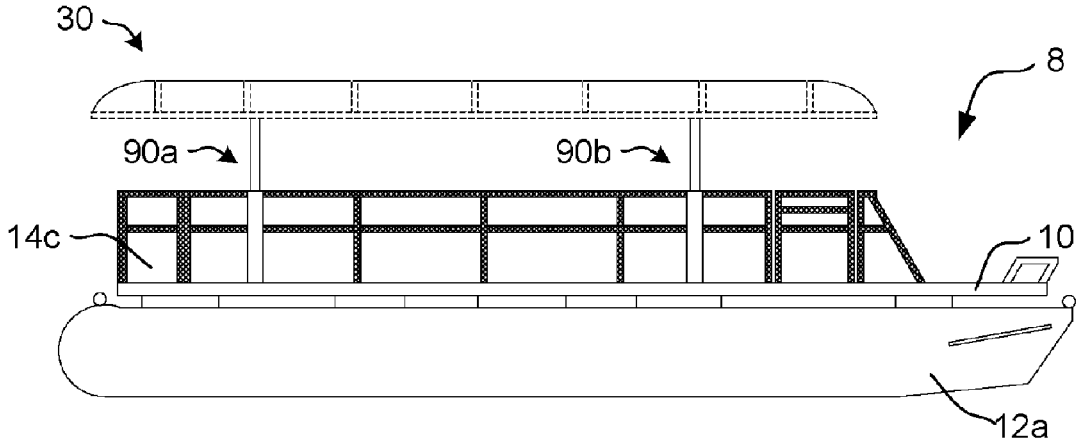
FIG. 6B is a schematic side view of the pontoon boat of FIG. 6A, with the cover assembly in an intermediate position.
Figure 6C:
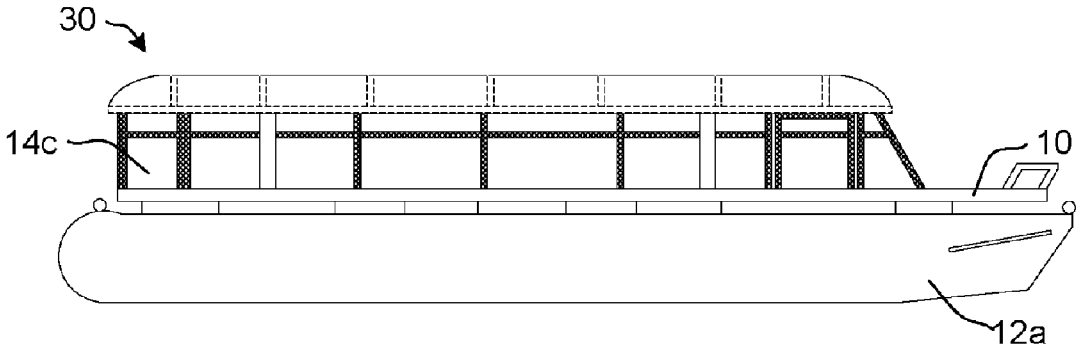
FIG. 6C is a schematic side view of the pontoon boat of FIG. 6A, with the cover assembly in a lowered position.

FIG. 6A is a schematic side view of the illustrative pontoon boat 8 of FIG. 1, with a cover assembly 30 in a raised position. FIG. 6B is a schematic side view of the pontoon boat of FIG. 6A, with the cover assembly in an intermediate position, and FIG. 6C is a schematic side view of the pontoon boat of FIG. 6A, with the cover assembly in a lowered position. In this illustrative embodiment, the cover assembly 30 is supported above the platform by one or more telescoping support members. In the illustrative embodiment, four telescoping support members 90*a* and 90*b* are used, with only the telescoping support members on the starboard side shown. However, more or less telescoping members may be used, as desired. The telescoping members 90*a* and 90*b* may be any type of telescoping member that telescopes between an extended position (see FIG. 6A) and a retracted position (see FIG. 6B and FIG. 6C). Illustrative telescoping members may include, for example, hydraulic cylinder type telescoping members, screw drive telescoping members, and/or any other type of telescoping member, as desired. The illustrative telescoping members 90*a* and 90*b* are shown having three telescoping sections, but it is contemplated that more or less telescoping sections may be used, as desired.

A lower end of the telescoping members 90*a* and 90*b* is shown secured to the platform 10, and an upper end of the telescoping members 90*a* and 90*b* is shown secured to the cover assembly 30. In some cases, the lower end or section of the telescoping members 90*a* and 90*b* may be secured to the side wall (such as side wall 14*c*) rather than, or in addition to, the platform 10, as desired.

When the cover assembly 30 is moved under human power, the telescoping members 90*a* and 90*b* may help provide a bias against gravity so that the cover assembly 30 can more easily be lifted from the lowered position (see FIG. 6C) to the raised position (see FIG. 6A). For example, and in one illustrative embodiment, the telescoping members 90*a* and 90*b* may be adapted to compress a gas and/or a fluid when the cover assembly 30 is moved from the raised position to the lowered position, which then provides a bias force in the opposite direction. This may also help limit the speed at which the cover assembly 30 drops from the raised position to the lowered position. It is contemplated that other suitable methods may be used to provide a bias against gravity to the cover assembly. In some embodiments, a locking mechanism may be provided to lock the telescoping members 90*a* and 90*b* in the extended position (see FIG. 6A) and/or the retracted position (see FIG. 6C), as desired.

When the cover assembly is moved using a powered system, such as by a motor or pump, the telescoping members 90*a* and 90*b* may be adapted to transfer energy from the motor or pump to movement between the retracted position (see FIG. 6C) and the extended position (see FIG. 6A). In some cases, the telescoping members 90*a* and 90*b* may be telescoping hydraulic cylinders that respond to hydraulic fluid being pumped into and out of the hydraulic cylinders. In other cases, the telescoping members 90*a* and 90*b* may be moved between the retracted position (see FIG. 6C) and the extended position (see FIG. 6A) using a screw drive. For example, the intermediate section of the telescoping members 90*a* and 90*b* may be in threaded engagement with the lower section of the telescoping members 90*a* and 90*b*, such that when the intermediate section is rotated relative to the lower section, the intermediate section moves in relation to the lower section. Likewise, the upper section of the telescoping members 90*a* and 90*b* may be in threaded engagement with the intermediate section of the telescoping members 90*a* and 90*b*, such that when the upper section is rotated relative to the intermediate section, the upper section moves in relation to the intermediate section. Any other suitable powered telescoping system may also be used, as desired.

Like the illustrative embodiment shown in FIGS. 2A-2C, the cover assembly 30 may be moved to the raised position (see FIG. 6A) to provide some level or protection to the occupants of the boat in the protected area 16 from the sun and/or other elements, particularly when the sun is directly overhead. When the user does not intend to use the boat, the telescoping members 90*a* and 90*b* may allow the cover assembly 30 to be moved to the lowered position (see FIGS. 6B-6C). In the lowered position, the cover assembly 30 may extend at least out to the side walls (e.g. sidewall 14*c*), and in some cases, may extend over and vertically overlap the top end of the side walls, around the perimeter of the protected area 16. This may help protect the protected area from the elements when the boat is not in use.

Figure 7A:
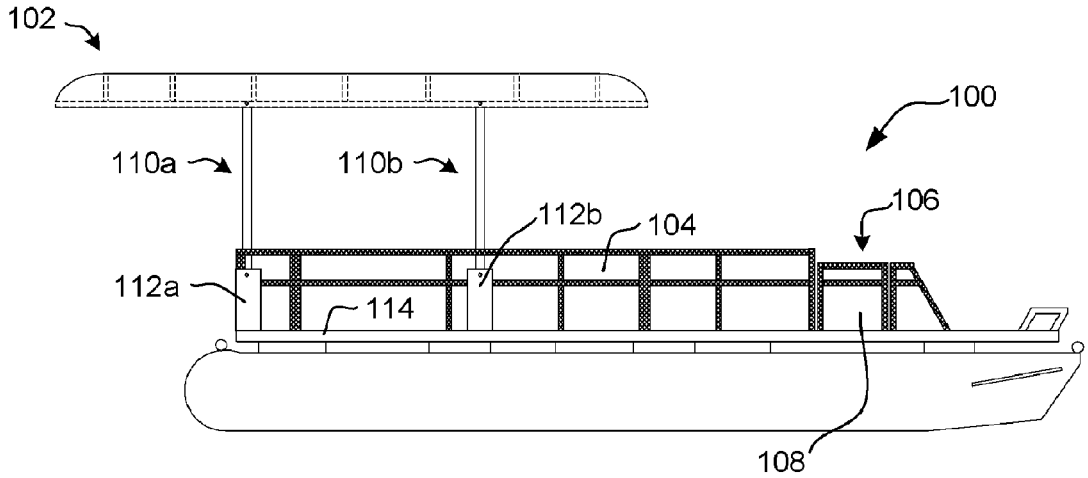
FIG. 7A is a schematic side view of another illustrative pontoon boat, with a cover assembly in a raised position.
Figure 7B:
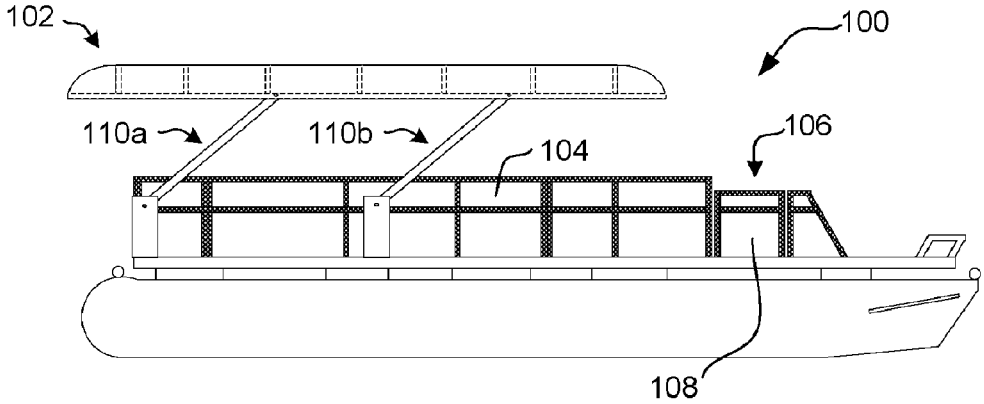
FIG. 7B is a schematic side view of the pontoon boat of FIG. 7A, with the cover assembly in an intermediate position.

FIG. 7A is a schematic side view of another illustrative pontoon boat 100, with a cover assembly 102 in a raised position. As can be seen, the pontoon boat 100 differs from the pontoon boat 8 of FIG. 1 in that the protected area is smaller. The protected area is defined by side walls, such as side wall 104, which extends around the perimeter of the protected area. A non-protected area 106 of the pontoon boat 102 may still include side walls 108, if desired, and as shown in FIGS. 7A-7B. In the illustrative embodiment, the side walls 108 of the non-protected area 106 extend out from the side walls of the protected area, and are lower in height. This may allow the cover assembly 102 to vertically overlap the top of the higher sidewalls 104 of the protected area, without interfering with the sidewalls 118 of the non-protected area 106.

In some cases, the sidewalls 108 of the non-protected area may be the same height as the side walls 104 of the protected area. When so provided, a slot may be provided in the side walls 108 of the non-protected area adjacent to the side walls of the protected area to allow the cover assembly 102 to vertically overlap the top of the higher side walls 104 of the protected area without interfering with the side walls 118 of the non-protected area 106. In another embodiment, a slot or the like may be provided in the cover assembly. Alternatively, the cover assembly 30 may extend out to and rest on the side walls 104 of the protected area, and thus no slot may be provided in the side walls 108 of the non-protected area 106. In yet another embodiment, no side walls may be provided around the non-protected area 106. Any other suitable configuration may also be used, as desired.

In the illustrative embodiment of FIG. 7A, the cover assembly 102 is supported above the platform by a number of pivoting support members. In the illustrative embodiment, four pivoting support members 110*a* and 110*b* are used, with only those on the starboard side shown. However, more or less pivoting support members may be used, as desired.

Figure 7C:
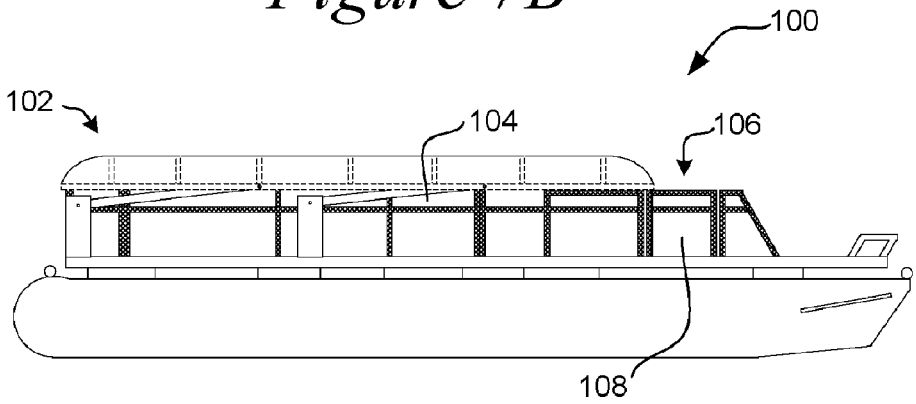
FIG. 7C is a schematic side view of the pontoon boat of FIG. 7A, with the cover assembly in a lowered position.

The lower end of each of the pivoting support members 110*a* and 110*b* is pivotally connected to the platform 114 and/or side walls 104 by a corresponding pivot member, such as pivot members 112*a* and 112*b*. In the illustrative embodiment, the upper end of each of the pivoting support members 110*a* and 110*b* is pivotally connected to the cover assembly 102, as shown. As the pivoting support members 110*a* and 110*b* rotate in a clockwise direction, the cover assembly 102 is moved forward and down (see FIG. 7B) until the cover assembly 102 engages and/or overlaps the side walls 104 (see FIG. 7C) to provide protection to the protected area of the pontoon boat 100. In some cases, the illustrative embodiment of FIGS. 7A-7C may allow more of the protected area of the pontoon boat 100 to be exposed to the sun and/or other elements when the cover assembly 102 is in the raised position. Like above, the cover assembly 102 may be moved between the raised position (see FIG. 7A) and the lowered position (see FIG. 7C) either under human power, or by powered system such as a motor or pump system.

Figure 8:
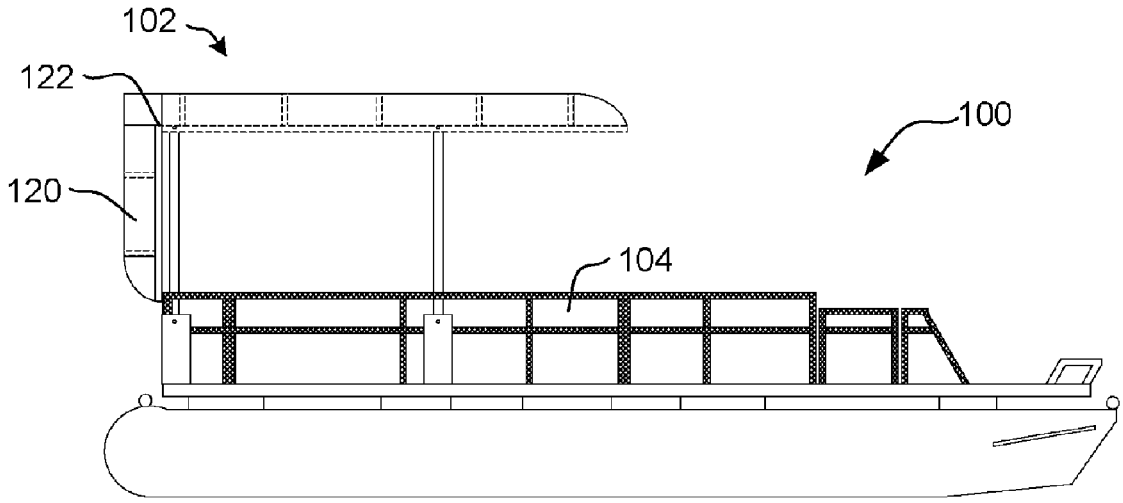
FIG. 8 is a schematic side view of the pontoon boat of FIG. 7A, with the cover assembly in the raised position and with a portion of the cover system folded down.

FIG. 8 is a schematic side view of the pontoon boat of FIG. 7A, with the cover assembly 102 in the raised position and with a portion 120 of the cover assembly 102 folded down. In the illustrative embodiment, the rearward portion 120 of the cover assembly 102 is hinged with the remainder of the cover assembly 102 at a hinge point 122. A lock mechanism may be provided to lock the rearward portion 120 in the upright position (see FIG. 7A), and/or in the folded down position (see FIG. 8), if desired. In some cases, the cover of the cover assembly may include one or more transparent or semi-transparent window(s) in the rearward portion 120 to help provide visibility in the rearward direction when the rearward portion 120 is folded down as shown. One or more transparent or semi-transparent window(s) may also be provided in the cover above the protected area, to provide additional light into the protected area when the cover assembly 102 is in the raised position, if desired.

Figure 9A:
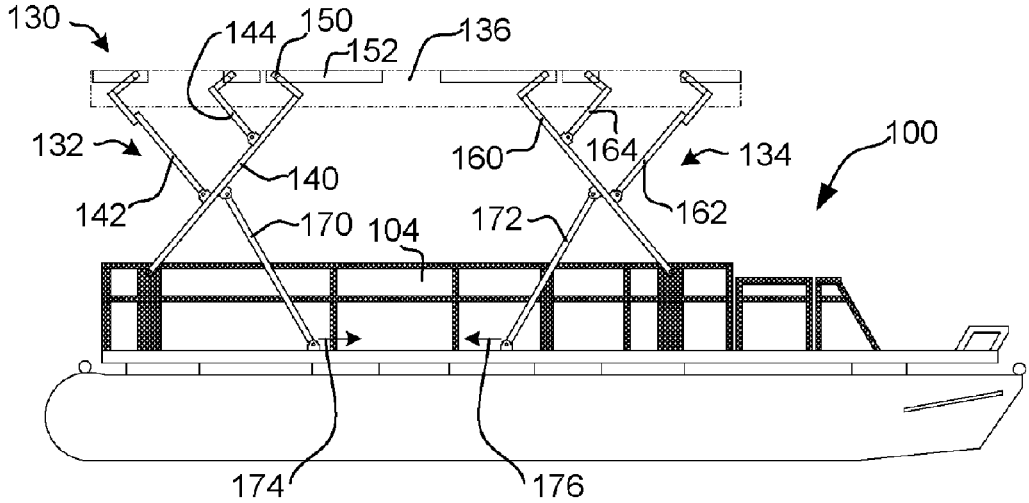
FIG. 9A is a schematic side view of another illustrative pontoon boat, with a cover assembly in a raised position.
Figure 9B:
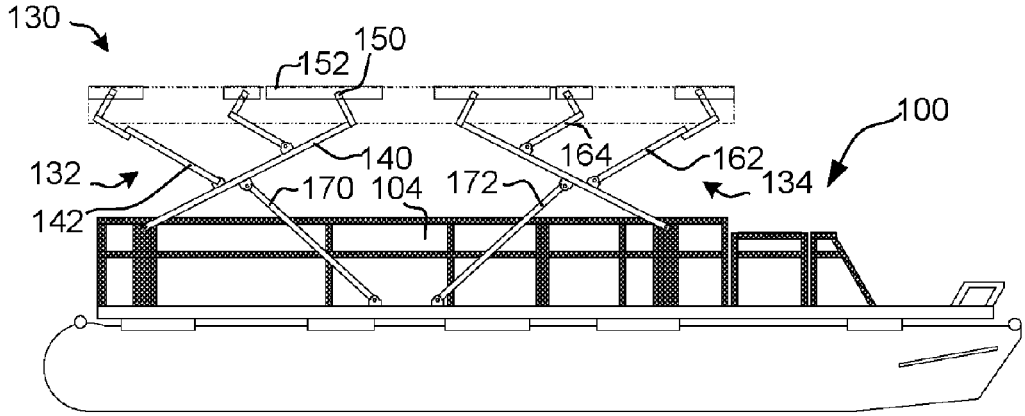
FIG. 9B is a schematic side view of the pontoon boat of FIG. 9A, with the cover assembly in an intermediate position.
Figure 9C:
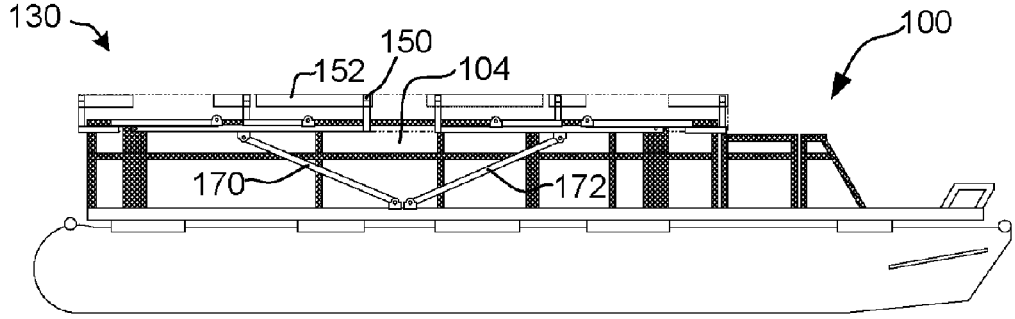
FIG. 9C is a schematic side view of the pontoon boat of FIG. 9A, with the cover assembly in a lowered position.

FIG. 9A is a schematic side view of the illustrative pontoon boat 100, with a cover assembly 130 in a raised position. FIG. 9B is a schematic side view of the pontoon boat of FIG. 9A, with the cover assembly 130 in an intermediate position, and FIG. 9C is a schematic side view of the pontoon boat 130 of FIG. 9A, with the cover assembly 130 in a lowered position. In this illustrative embodiment, cover assembly 130 includes a rear support frame 132 and a front support frame 134, wherein both the front support frame 132 and the rear support frame 134 support a cover 136. A front and a rear support frame may also be provided on the port side of the pontoon boat 100, but they are not shown in FIGS. 9A-9C.

In the illustrative embodiment, the rear support frame 132 includes a main pivoting support member 140, with a number of pivoting cover supports 142 and 144 extending off of the main pivoting support member 140. The upper ends of the main pivoting support member 140 and each of the pivoting cover supports 142 and 144 may include a laterally extending member that extends transversely (into the page) across the protected area of the pontoon boat 100. In some cases, the laterally extending members may each be received by a pocket or sleeve formed in the lower side of the cover 136.

Likewise, the front support frame 134 may include a main pivoting support member 160, with a number of pivoting cover supports 162 and 164 extending off of the main pivoting support member 160. The upper ends of the main pivoting support member 160 and each of the pivoting cover supports 162 and 164 may include a laterally extending member that extends transversely (into the page) across the protected area of the pontoon boat 100. The laterally extending members may each be received by a pocket or sleeve formed in the lower side of the cover 136.

When the cover assembly 130 is in the fully raised position (see FIG. 9A), each laterally extending member may engage one side of its corresponding pocket or sleeve. For example, the laterally extending member 150 may engage the left side of its corresponding pocket 152. Likewise, when the cover assembly 130 is in the fully lowered position (see FIG. 9C), each laterally extending member may engage the other side of it's corresponding pocket or sleeve. For example, the laterally extending member 150 may engage the right side of its corresponding pocket 152. This may help the cover 136 to be pulled tight in both the raised position and lowered position, while allowing the rear support frame 132 and the front support frame 134 to change support configurations during the transition.

The lower ends of the main pivoting support members 140 and 160 may be pivotally attached to the side wall 104 of the pontoon boat 100. In the illustrative embodiment shown, the main pivoting support member 140 is pivotally attached to the side wall 104 near the rear of the pontoon boat 100, and the main support member 160 is pivotally attached to the side wall 104 near the front of the pontoon boat 100. As the main support member 140 is rotated clockwise, and the main support member 160 is rotated counter-clockwise, the cover assembly 130 moves from the raised position shown in FIG. 9A to the lowered position shown in FIG. 9C.

In some embodiments, a rear driving support member 170 is pivotally attached to the rear main pivoting support member 140, and a front driving support member 172 is pivotally attached to the front main pivoting support member 160. The lower end of the rear driving support member 170 may be adapted to be moved in the rightward direction, as indicated by arrow 174, to move the cover assembly 130 from the raised position to the lowered position. Likewise, the lower end of the front driving support member 172 may be adapted to be moved in the leftward direction, as indicated by arrow 176, to move the cover assembly 130 from the raised position to the lowered position. Conversely, the lower end of the rear driving support member 170 may be adapted to be moved in the leftward direction to move the cover assembly 130 from the lowered position to the raised position, and the lower end of the front driving support member 172 may be adapted to be moved in the rightward direction to move the cover assembly 130 from the lowered position to the raised position.

Figure 15:
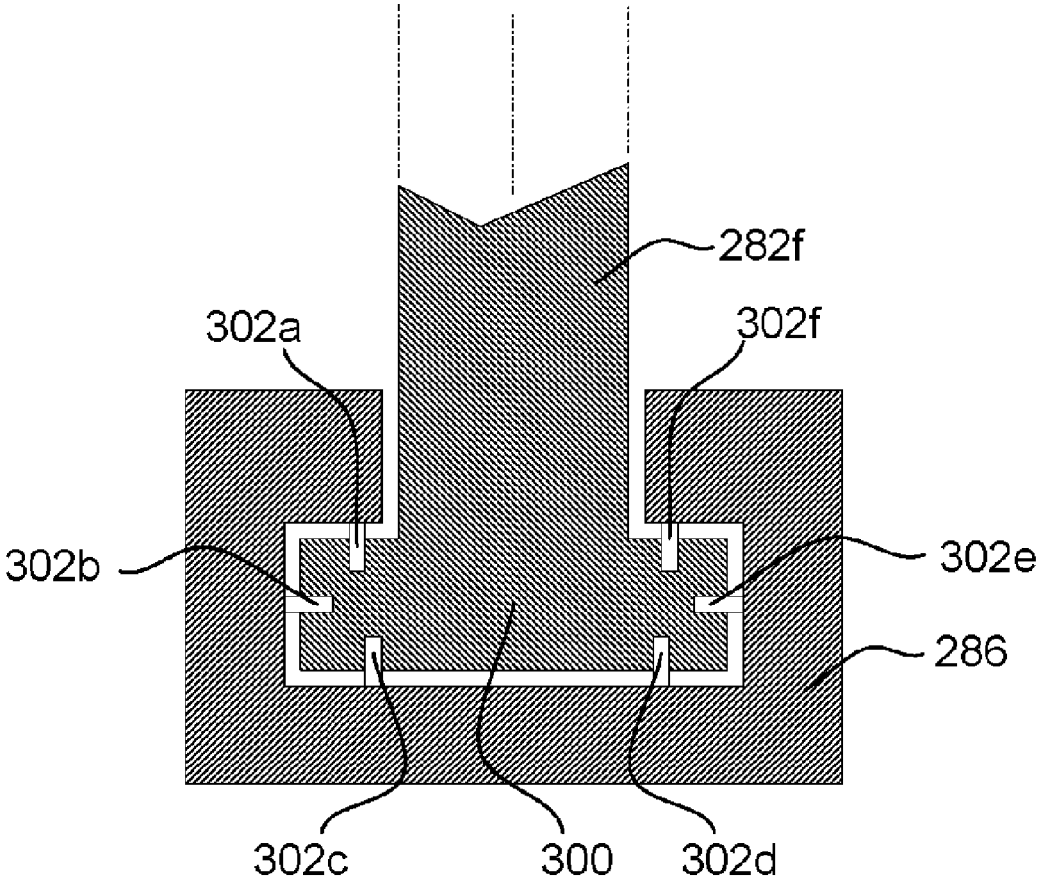
FIG. 15 is a schematic cross-sectional side view of a track and a movable support member.

In some embodiments, the lower end of the rear driving support member 170 and the lower end of the front driving support member 172 may be slide along a track or the like, wherein the track or the like is attached to the platform and/or side walls of the pontoon boat 100 (see, for example, FIG. 15). A drive mechanism may be provided for moving the lower end of the rear driving support member 170 and the lower end of the front driving support member 172 along the track. The drive mechanism may include, for example, a belt, a cable, a chain, a screw drive, a hydraulic drive, or any other suitable drive mechanism, as desired.

Figure 10:
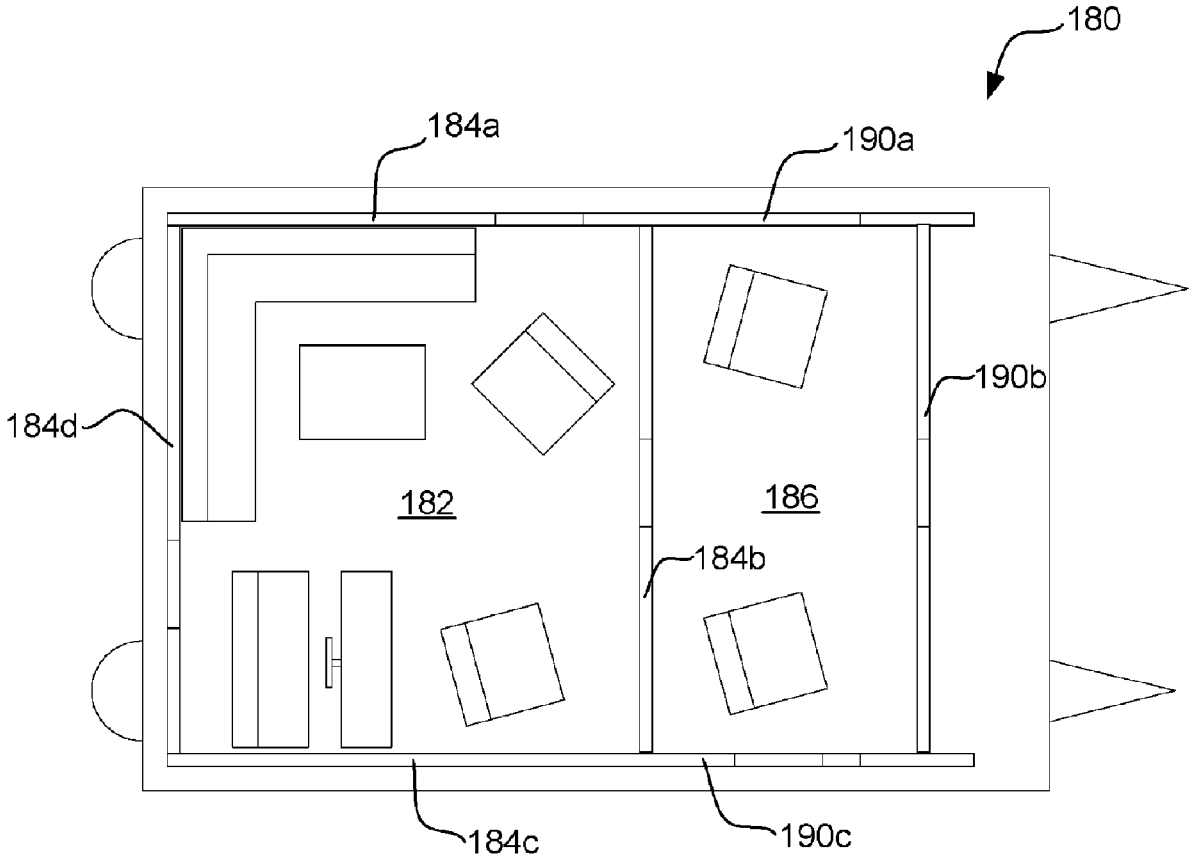
FIG. 10 is a schematic top view of another illustrative pontoon boat with a smaller protected area defined by side walls.

FIG. 10 is a schematic top view of another illustrative pontoon boat, generally shown at 180. As can be seen, the pontoon boat 180 differs from the pontoon boat 8 of FIG. 1 and the pontoon boat 100 of FIG. 7A in that the protected area 182 is even smaller in size. The protected area is defined by side walls 184*a*-184*d*, which extend around the perimeter of the smaller protected area 182. In some cases, a non-protected area 186 of the pontoon boat 180 may still include side walls 190*a*-190*c*. In the illustrative embodiment, the side walls 190*a*-190*c* of the non-protected area 186 extend out from side wall 184*b* of the protected area 182 and are lower in height, but his is not required in all embodiments. This may allow a cover assembly to vertically overlap the top of the higher sidewalls 184*a*-184*d* of the protected area 182, without interfering with the sidewalls 190*a* and 190*c* of the non-protected area 186.

In some cases, the sidewalls 190*a*-190*c* of the non-protected area 186 may be the same height as the side walls 184*a*-184*d* of the protected area 182. When so provided, a slot may be provided in the side walls 190*a* and 190*c* of the non-protected area 186 adjacent to the side wall 184*b* of the protected area 182 to allow a cover assembly to vertically overlap the top of the higher side walls 184*a*-184*d* of the protected area 182 without interfering with the side walls 190*a* and 190*c* of the non-protected area 186. Alternatively, a cover assembly may extend out to and rest on the side walls 184*a*-184*d* of the protected area 182, and thus no slot may be needed in the side walls 190*a* and 190*c* of the non-protected area 186. In another embodiment, a slot or the like may be provided in the cover assembly. In yet another embodiment, no side walls may be provided around the non-protected area 186. Any other suitable configurations may also be used, as desired.

By providing a smaller protected area 182 than in the pontoon boat 8 of FIG. 1 and the pontoon boat 100 of FIG. 7A, a cover assembly may be made smaller. This may reduce the cost of the cover assembly and drive mechanism, and may allow more of the platform of the pontoon boat 180 to be exposed to the sun when the cover assembly is in the raised position. This may be more desirable for some boaters.

Figure 11A:
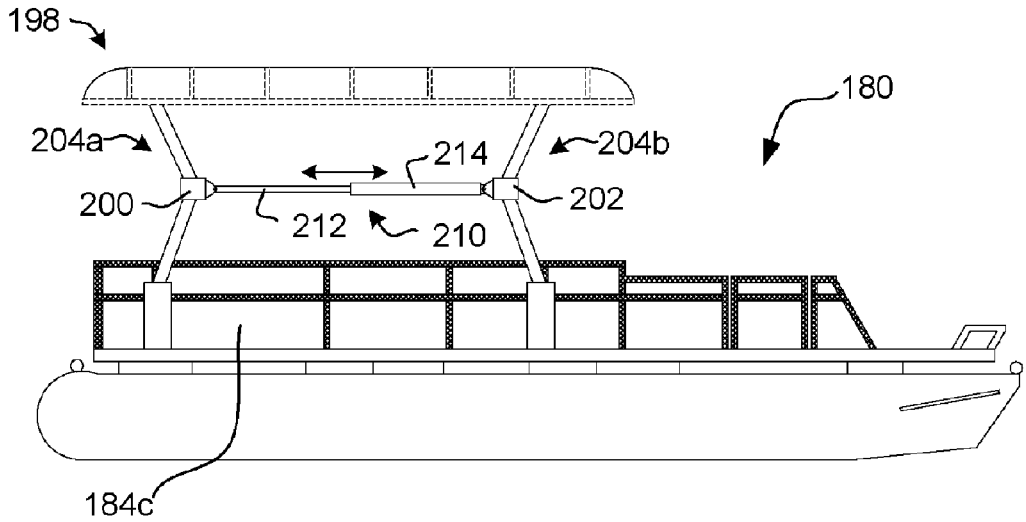
FIG. 11A is a schematic side view of another illustrative pontoon boat, with a cover assembly in a raised position.
Figure 11B:
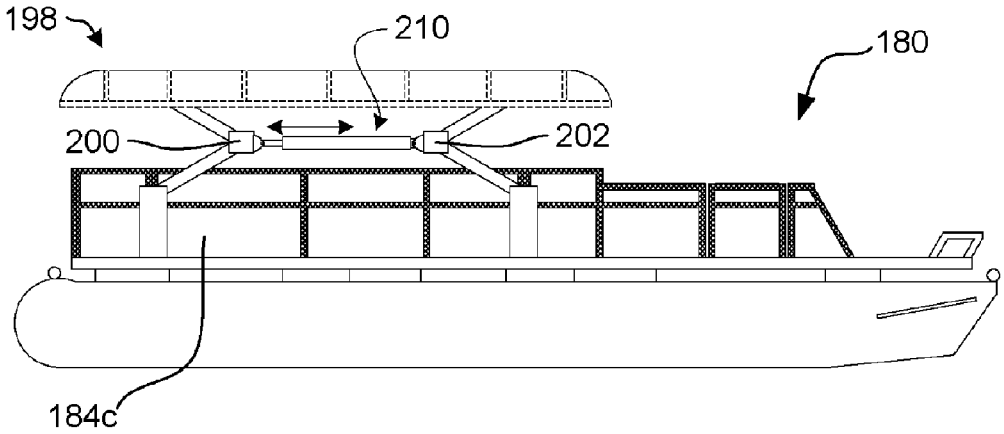
FIG. 11B is a schematic side view of the pontoon boat of FIG. 11A, with the cover assembly in an intermediate position.
Figure 11C:
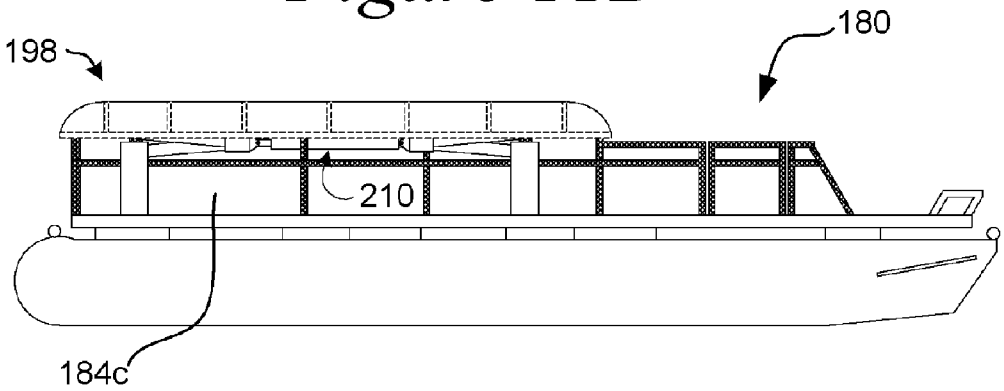
FIG. 11C is a schematic side view of the pontoon boat of FIG. 11A, with the cover assembly in a lowered position.

FIG. 11A is a schematic side view of the illustrative pontoon boat 180, with a cover assembly 198 in a raised position. FIG. 11B is a schematic side view of the pontoon boat 180 of FIG. 11A, with the cover assembly 198 in an intermediate position, and FIG. 11C is a schematic side view of the pontoon boat 180 of FIG. 11A, with the cover assembly 198 in a lowered position.

The illustrative cover assembly 198 is similar to that shown and described with reference to FIGS. 2A-2C. However, in this illustrative embodiment, a screw drive mechanism generally shown at 210 is provided between pivot points 200 and 202 of cover supports 204*a* and 204*b*. The screw drive mechanism 210 may include, for example, a rotating screw 212 that is threaded with a support member 214. A motor or the like may be provided at or near the pivot point 200 to rotate the rotating screw 212. Alternatively, or in addition, a motor or the like may be provided at or near the pivot point 202 to rotate the support member 214. Depending on the direction that the rotating screw 212 (and/or support member 214) is rotated, the rotating screw 212 moves either in or out of the support member 214, causing the cover assembly 198 to move toward the raised position (see FIG. 11A) or toward the lowered position (see FIG. 11C).

In some embodiments, the screw drive mechanism 210 may be similar to the screw drive used in FLOE Vertical Screw Boat Lifts, commercially available from FLOE International Inc., located in McGregor, Minn. In some cases, only one screw drive mechanism 210 is used, and may be positioned on, for example, either the starboard or port side of the pontoon boat 180. In other cases, a screw drive mechanism 210 may be provided on both sides of the pontoon boat 180, but this is not required in all embodiments. Also, although the screw drive mechanism 180 is shown in conjunction with pontoon boat 180, it is contemplated that the screw drive mechanism 180 may be used on other boats, including the pontoon boat 8 of FIG. 1 and the pontoon boat 100 of FIG. 7A, as desired.

Figure 12A:
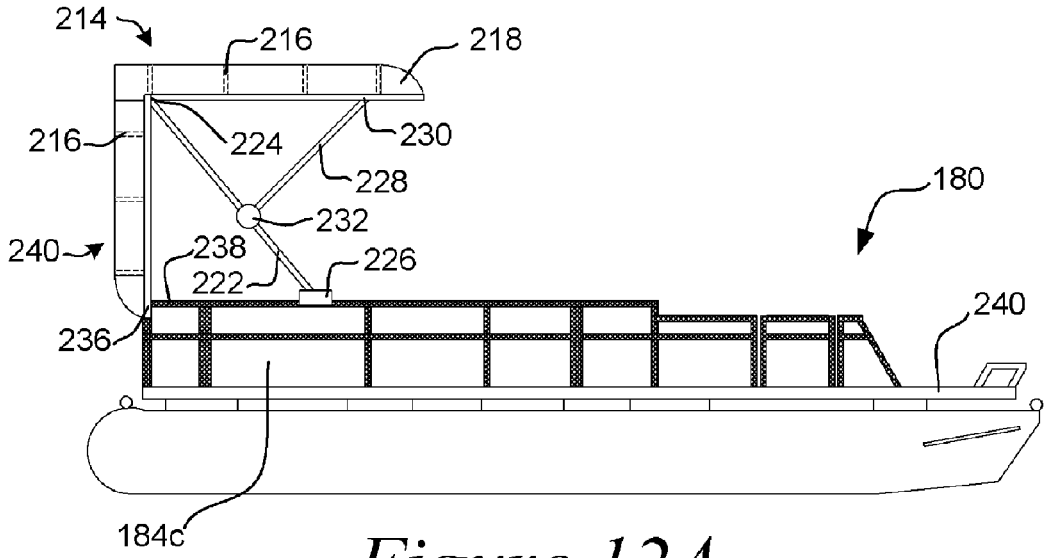
FIG. 12A is a schematic side view of another illustrative pontoon boat, with a cover assembly in a raised position.
Figure 12B:
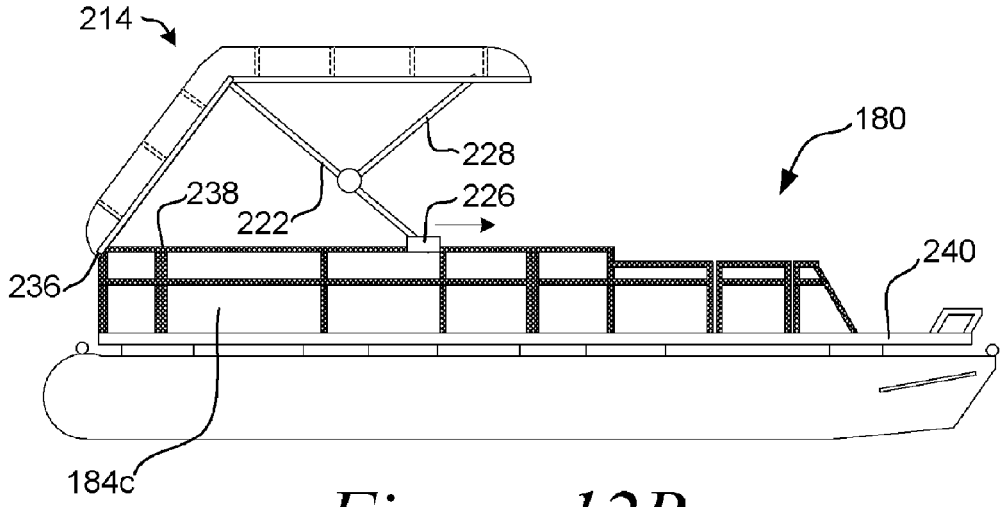
FIG. 12B is a schematic side view of the pontoon boat of FIG. 12A, with the cover assembly in an intermediate position.
Figure 12C:
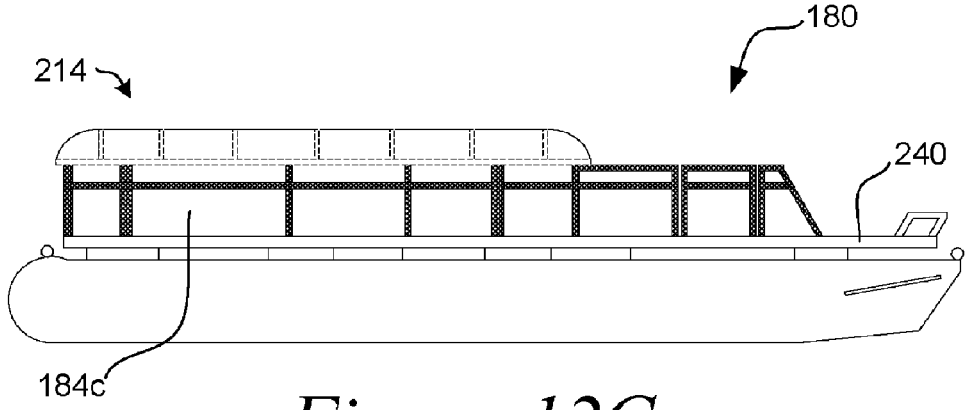
FIG. 12C is a schematic side view of the pontoon boat of FIG. 12A, with the cover assembly in a lowered position.

FIG. 12A is a schematic side view of the illustrative pontoon boat 180 of FIG. 10, with a movable cover assembly 214 in a raised position. FIG. 12B is a schematic side view of the pontoon boat 180 of FIG. 12A, with the cover assembly 214 in an intermediate position, and FIG. 12C is a schematic side view of the pontoon boat 180 of FIG. 12A, with the cover assembly 214 in a lowered position. The illustrative cover assembly 214 includes a support frame 216 that supports a cover 218. In the illustrative embodiment, the support frame 216 is hinged at an intermediate location 224. A top end of a first support member 222 may be pivotally connected to the support frame 216 at or near the intermediate location 224, as shown. A lower end of the first support member 222 may be connected to a track car 226. The track car 226 may be adapted to slide along a track or the like (see, for example, FIG. 15) that is positioned along the top of the side wall 238, along the platform 240 of the pontoon boat 180, or along some other location, as desired.

In the illustrative embodiment, a top end of a second support member 228 may be pivotally connected to a more forward location 230 of the support frame 216, as shown. A lower end of the second support member 228 may be pivotally connected to an intermediate location 232 of the first support member 222. A rear end of the support frame 216 of the cover assembly 214 may be pivotally connected to the side wall 238 at a rear location 236, the platform 240, or at some other location, as desired.

During use, the track car 226 may be moved forward from the location shown in FIG. 12A. As the track car 226 is moved forward, the cover assembly 214 begins to move forward and down, as shown in FIG. 12B. When the track car 226 is moved sufficiently far forward, the cover assembly 214 moves to a lowered position, as shown in FIG. 12C. In the lowered position, the cover assembly 214 may extend at least out to the side walls (e.g. sidewall 184*c*), and in some cases, may extend over and vertically overlap the top end of the side walls, around the perimeter of the protected area 182. This may help protect the protected area 182 from the elements when the boat 180 is not in use. In some cases, the track car 226 may be moved under human power, while in others, the track car 226 may be moved using a powered motor, pump or other such device.

In some embodiments, the cover 218 may include a transparent or semi-transparent window. For example, such a window may be provided in a window region 240 in the cover 218. This may improve the visibility in a rearward direction when the cover is in the raised position.

Figure 13A:
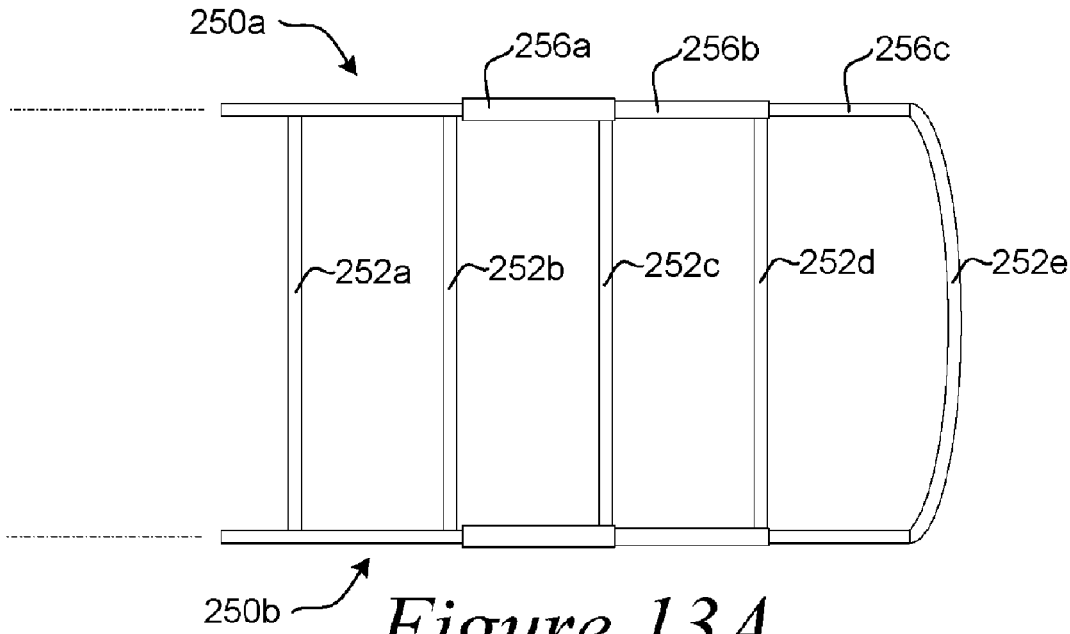
FIG. 13A is a schematic top view of a cover assembly in an extended position.

FIG. 13A is a schematic top view of a cover assembly in an extended position. The illustrative cover assembly includes a support frame that has side support members 250*a* and 250*b*, and a number of transverse support members 252*a*-252*e*. The side support members 250*a* and 250*b* may extend the length of the support frame, and the transverse support members 252*a*-252*e* may extend the width of the support frame. The side support members 250*a*-250*b* and the transverse support members 252*a*-252*e* may be adapted to support a cover (not explicitly shown in FIGS. 13A-12C).

Figure 13B:
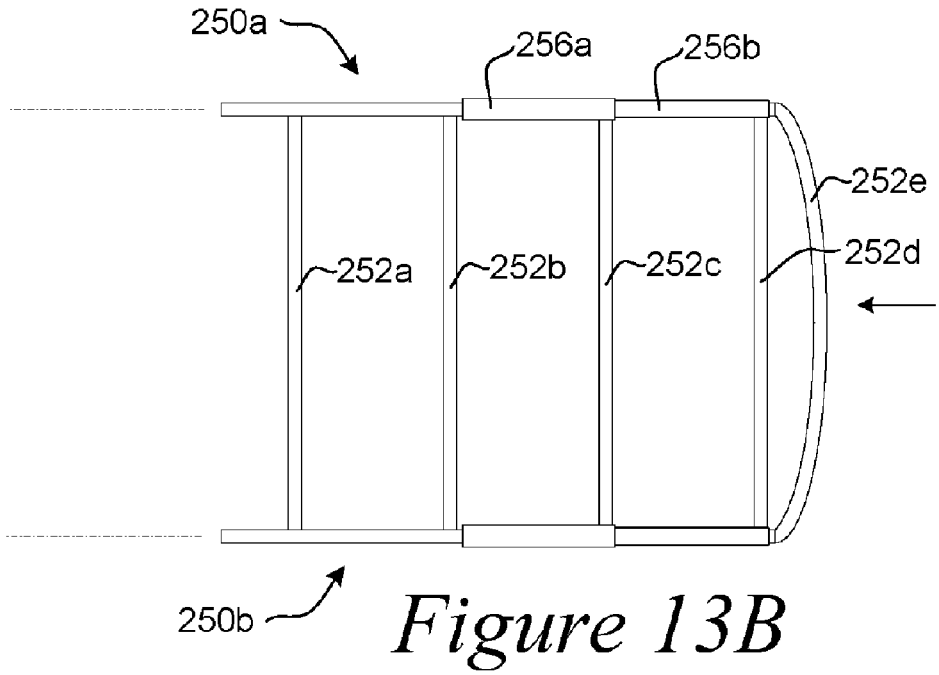
FIG. 13B is a schematic top view of a cover assembly in an intermediate extended position.
Figure 13C:
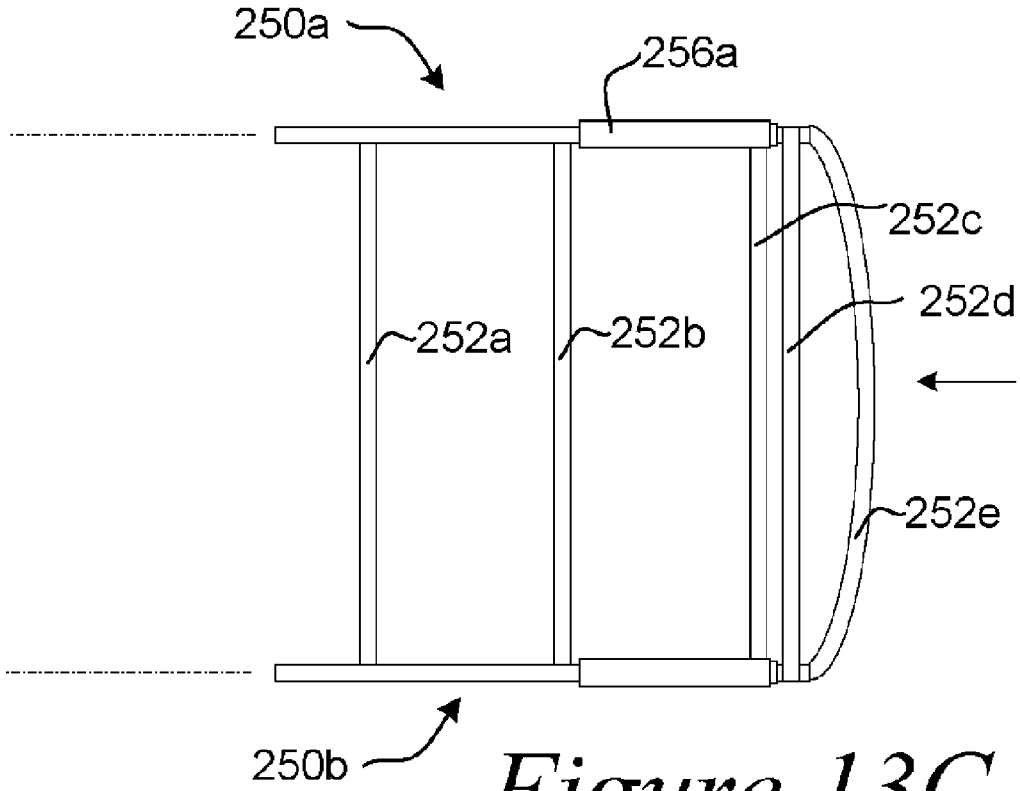
FIG. 13C is a schematic top view of a cover assembly in a retracted position.

In some embodiments, the support frame may be moved between an extended position and a retracted or partially retracted position. This may allow the occupants of a boat to adjust the area of the boat that is covered by the cover assembly, particularly when the cover assembly is in the raised position. In the illustrative embodiment, the side support members 250*a* and 250*b* may each include telescoping sections, such as telescoping sections 256*a*-256*c*. By pushing on the transverse support member 252*e*, telescoping section 256*c* may be moved into telescoping section 256*b*, allowing the transverse support member 252*e* to be retracted toward transverse support member 252*d*, as shown in FIG. 13B. Likewise, by pushing on the transverse support member 252*d*, telescoping section 256*b* may be moved into telescoping section 256*a*, allowing the transverse support member 252*d* to be retracted toward transverse support member 252*c*, as shown in FIG. 13C. While a telescoping arrangement is shown in FIGS. 13A-13C, it is contemplated that any suitable arrangement may be used to move the support frame (and cover) between an extended position and a retracted or partially retracted position.

Figure 14A:
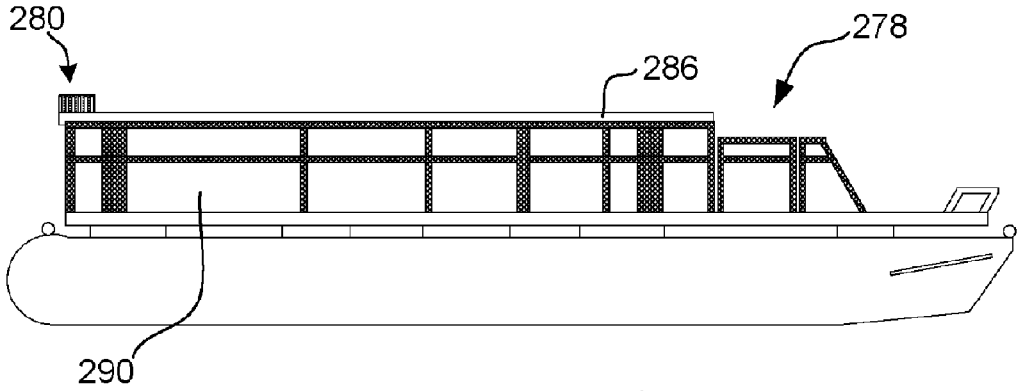
FIG. 14A is a schematic side view of another illustrative pontoon boat, with a cover assembly in retracted storage position.
Figure 14B:
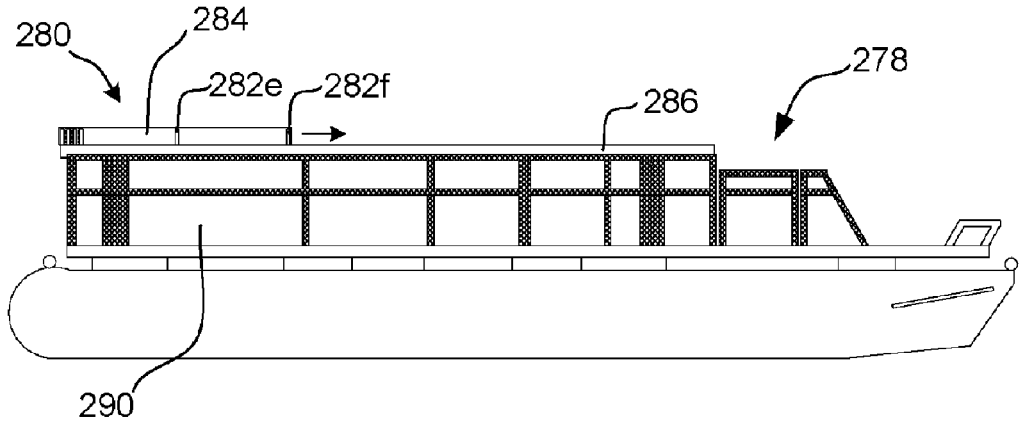
FIG. 14B is a schematic side view of the pontoon boat of FIG. 14A, with the cover assembly in an intermediate position.
Figure 14C:
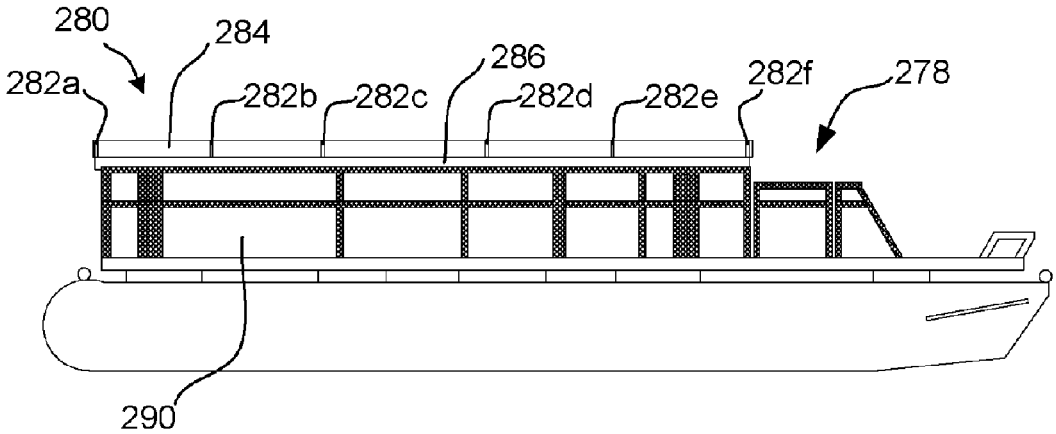
FIG. 14C is a schematic side view of the pontoon boat of FIG. 14A, with the cover assembly in an extended covering position.

FIG. 14A is a schematic side view of another illustrative pontoon boat 278, with a cover assembly 280 in a retracted storage position. FIG. 14B is a schematic side view of the pontoon boat 278 of FIG. 14A, with the cover assembly 280 in an intermediate position, and FIG. 14C is a schematic side view of the pontoon boat 278 of FIG. 14A, with the cover assembly 280 in an extended covering position. In the illustrative embodiment, the cover assembly includes a number of transverse support members 282*a*-282*f* that support a cover 284.

Each of the transverse support members 282*a*-282*f* may be connected to a track car (e.g. track car 300 in FIG. 15), that slides along a track 286. In the illustrative embodiment, a right track 286 extends along the right side wall (e.g. side wall 290) of a protected area of the pontoon boat 278, and a left track extends along the left side wall (not shown) of a protected area of the pontoon boat 278. It is contemplated, however, that the tracks may extend along the front and back side walls of the protected area, if desired.

From the retracted position shown in FIG. 14A, the track cars attached to the most forward transverse support member 282*f* may be moved in a forward direction, as shown in FIG. 14B. When the most forward transverse support member 282*f* moves forward sufficiently far, the next transverse support member 282*e* may be moved forward (see FIG. 14B). This continues until the most forward transverse support member 282*f* reaches the front of the protected area of the pontoon boat (see FIG. 14C).

In some embodiments, the cover 284 may include a number of spaced pockets or sleeves that each are adapted to receive a corresponding one of the transverse support members 282*a*-282*f*. Thus, when the most forward transverse support member 282*f* is pulled forward sufficiently far, so that the portion of the cover 284 between the most forward pocket or sleeve and the pocket or sleeve that receives the next transverse support member 282*e* becomes tight, the cover begins pulling the next transverse support member 282*e* forward. This may continue until the most forward transverse support member 282*f* reaches the front of the protected area of the pontoon boat (see FIG. 14C). In the illustrative embodiment, the rear most transverse support member 282*a* may be fixed at or near the rear of the protected area of the pontoon boat. It is contemplated that the transverse support member 282*a*-282*f* may extend up from the side walls sufficiently far to support the cover and provide clearance over seats, control consoles and/or anything else in the protected area, if desired.

In some cases, the transverse support members 282*a*-282*f* may be moved under human power, while in others, the transverse support members 282*a*-282*f* may be moved using a powered motor, pump or other such device.

FIG. 15 is a schematic cross-sectional side view of a track and a movable support member. In the illustrative embodiment, the movable support member may be the transverse support member 282*f* of FIGS. 14A-14C. However, the movable support member may be any other support member, including those shown and described in other embodiments of the present invention.

The movable support member may be connected to a track car 300 as shown. It is contemplated that the movable support member may be directly connected to the track car 300, pivotally connected, integrally formed with, or connected in any other suitable way. A track 286 may be provided for receiving the track car 300. In the illustrative embodiment, the track 286 includes a cavity that is shaped to receive the track car 300. In some embodiments, the track car 300 may include one or more sliders 302*a*-302*f*. The sliders 302*a*-302*f* may be made from plastic, Teflon™, metal, or any other suitable material, as desired. The sliders 302*a*-302*f* may help reduce the friction between the track car 300 and the track 286. In some cases, the sliders 302*a*-302*f* may include wheels, ball bearings or the like. The track 286 and track car 300 arrangement may be used in conjunction with any number of illustrative embodiments, including those shown in FIGS. 9A-9C, 12A-12C, 14A-14C, as well as other embodiments, as desired.

Figure 16:
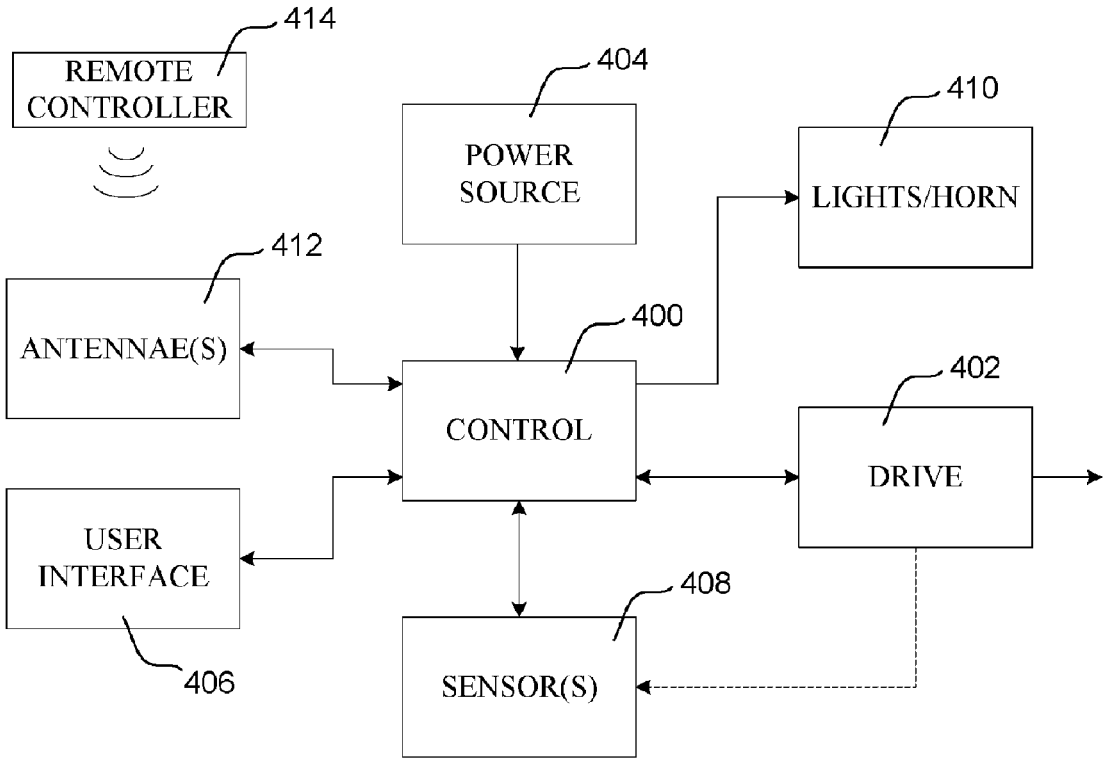
FIG. 16 is a schematic block diagram of a control system for a movable cover system for a boat.

FIG. 16 is a schematic block diagram of a control system for a powered cover system for a boat. The illustrative control system may include a controller 400 that is coupled to a drive mechanism 402. The drive mechanism 402 may include, for example, a motor, a pump, or any other powered system for moving the cover system of a boat between a first position and a second position. The drive mechanism 402 may also receive power from a power source 404, either directly or from the controller 400, as desired.

The controller 400 may be adapted to control the drive mechanism 402 to move the cover system between a first position (e.g. raised or retracted position) and a second position (e.g. lowered or extended position). The controller 400 may include, for example, a microprocessor, a number of relays or power transistors, a memory, switches, a timer and/or any other suitable device or devices to provide the desired level of control.

In some embodiments, the controller 400 may be coupled to a user interface 406. The user interface 406 may allow a user to interact in some way with the controller 400. For example, the user interface 406 may include one or more switches and/or buttons. In some cases, the user interface may include a display, such as an LCD display, and/or one or more light indicators such as LED indicators. In some cases, the user interface 406 may be mounted on the control console of the boat.

The controller 400 may also be coupled to one or more sensors 408. The sensors may include, for example, a rain sensor, a wind speed sensors, a light sensor, a current and/or voltage sensor, and/or any other type of sensors as desired. In one example, the controller 400 may receive a signal from a rain sensor that indicates that rain is present, and may move the cover from a raised position to a lowered position. The controller 400 may also be coupled to one or more lights and/or horns 410. The controller 400 may first provide a warning light and/or warning sound via the lights and/or horns 410 prior to moving the cover from the raised position to the lowered position. In some cases, the user may override the controller 400 from moving the cover from the raised position to the lowered position after the warning light and/or warning sound is provided.

In another example, the controller 400 may receive a signal from a wind speed sensor that indicates that the wind speed has exceeded a threshold value, and may move the cover from a raised position to a lowered position. In some cases, the controller 400 may first provide a warning light and/or warning sound via the lights and/or horns 410 prior to moving the cover from the raised position to the lowered position. In some cases, the user may override the controller 400 from moving the cover from the raised position to the lowered position after the warning light and/or warning sound is provided.

In yet another example, the controller 400 may receive a signal from a light detector that indicates that the sun has gone down, and may move the cover from a raised position to a lowered position. In some cases, the controller 400 may first provide a warning light and/or warning sound via the lights and/or horns 410 prior to moving the cover from the raised position to the lowered position. In some cases, the user may override the controller 400 from moving the cover from the raised position to the lowered position after the warning light and/or warning sound is provided.

The controller 400 may also monitor one or more current or voltage sensors to determine if the boat is or has recently been underway, and/or if there are other signs that occupants may be using the boat (e.g. radio on). In some cases, the controller 400 may not move the cover from the raised position to the lowered position if the boat is currently underway or it is believed that the boat is otherwise currently occupied.

The controller 400 may also monitor one or more current or voltage sensors to determine the load on the drive mechanism 402. If the load on the drive mechanism 402 exceeds a threshold value, the controller 400 may remove power from the drive mechanism 402, or reverse the direction of movement of the cover. This may provide a level of safety, much like the safety mechanisms of a garage door opener.

The controller 400 may also receive a command from the user interface 406 to move the cover between a first position and a second position. In some cases, the controller 400 may include a timer, and the controller may provide one or more visual and/or audible warnings via lights and/or horns 410 over a period of time, as specified by the timer, before moving the cover between the first position and the second position. This may provide a level of safety so that people around the boat will know that the cover is about to be moved. When the user interface is mounted in the boat, such as on the control console, this delay may allow a user sufficient time to egress the boat before the cover is moved between the first position and the second position.

In some cases, the drive mechanism 402 may control the position of the cover, both in an upward and downward direction. Thus, when the cover is in the lowered or covering position, the cover may not be able to be easily moved without activating the drive mechanism 402. Thus, in some cases, the cover may provide some level or security to the contents in the boat when the boat is not in use. The controller 400 may be adapted to require a key, a code or some other security measure to help prevent unauthorized activation and movement of the cover.

In some cases, the controller 400 may be coupled to one or more antennae 412. A remote controller 414 may be provided to provide remote control signals to the controller 400. For example, the remote controller 414 may provide a command to move the cover from a first position to a second position, or visa versa. The controller 400 may receive this command via the antennae 412, and instruct the drive mechanism 402 to perform the requested action. The controller 400 may also be programmed to turn on one or more lights and/or provide one or more sounds or the like before and/or during some actions. For example, when the controller 400 receives an instruction to move the cover from a raised position to a lowered position, the controller may first beep a warning tone for a period of time, turn on or flash one or more lights, and then instruct the drive mechanism to move the cover from the raised position to the lowered position, if desired. It is contemplated that the remote controller 414 may be any type of remote control device, and in some cases, may be similar to a remote keyless entry device commonly used for automobiles.

Having thus described the preferred embodiments of the present invention, those of skill in the art will readily appreciate that yet other embodiments may be made and used within the scope of the claims hereto attached. It will be understood that this disclosure is, in many respect, only illustrative. Changes may be made in details, particularly in matters of shape, size, and arrangement of parts without exceeding the scope of the invention.

What is claimed is:

1. A cover assembly for a boat, wherein the boat has a front, a back, a length, and two sides, the boat further having side walls extending up from a floor of the boat on at least two lateral sides of the boat defining at least part of a protected area, the protected area corresponding to an open deck portion of the boat that can accommodate occupants of the boat during normal use of the boat, the one or more side walls are configured to prevent or substantially prevent windswept rain from passing through the side walls of the boat and into the protected area from a lateral direction, the cover assembly comprising:

a cover having a front edge, a rear edge and two lateral side edges collectively defining the covering extent of the cover;

a support frame for supporting the cover above the boat, the support frame configured to allow the cover to be moved between a raised position and a lowered position, wherein, in the lowered position, the two lateral sides of the cover are lowered to be adjacent to a top end of a corresponding side wall on each of the least two lateral sides of the boat such that windswept rain is prevented or substantially prevented from entering the at least part of the protected area between the cover and the corresponding side walls, and in the raised position, the cover is suspended above the floor sufficiently far so that occupants of the boat can move about there under;

the support frame having one or more elongated laterally rigid support members positioned along each of two lateral sides of the boat, each of the one or more elongated laterally rigid support members are part of, or fixed to, the support frame in both the raised position and lowered position and traverse from a coupling end toward the cover, wherein the coupling end of each of the elongated laterally rigid support members is configured to be rotatably coupled relative to the boat about a rotational axis, wherein each of the one or more elongated laterally rigid support members are configured to rotate about the corresponding rotation axis and remain laterally rigid when the cover is moved between the raised position and the lowered position; and the support frame further configured such that the entire front edge of the cover is movable in a lengthwise direction relative to the rear edge of the cover to shorten the covering extent of the cover assembly in the lengthwise direction when moving from an extended position to a retracted position.

2. The cover assembly of claim 1 further comprising:

a motor for moving the cover between the lowered position and the raised position.

3. The cover assembly of claim 2 further comprising a screw drive device coupled to the motor for transferring energy from the motor to move the cover between the lowered position and the raised position.

4. The cover assembly of claim 1 further comprising:

a pump; and one or more hydraulic cylinders coupled to the pump for transferring energy from the pump to move the cover between the lowered position and the raised position.

5. The cover assembly of claim 1 wherein, in the lowered position, the two lateral side edges of the cover extend laterally out past the side walls of the boat.

6. The cover assembly of claim 1 wherein, in the lowered position, the two lateral side edges of the cover assembly extend laterally out past the side walls and overlaps in a vertical direction a top portion of the one or more side walls.

7. The cover assembly of claim 1 wherein the cover is moved between the raised position and the lowered position under influence of a motor.

8. The cover assembly of claim 1 wherein the cover is moved between the raised position and the lowered position under human power.

9. The cover assembly of claim 1 wherein the cover is moved between the raised position and the lowered position under influence of a pump and one or more hydraulic cylinders.

10. The cover assembly of claim 1 wherein one or more components of the support frame are provided in a telescoping arrangement.

11. The cover assembly of claim 10 wherein one or more of the elongated laterally rigid support members are provided in a telescoping arrangement.

12. The cover system of claim 1, wherein the rotation axis of each elongated laterally rigid support member is positioned at a fixed location along the length of the boat when the cover is moved between the raised position and the lowered position.

13. A cover assembly for a boat, wherein the boat has a front, a back, a length, and two sides, the boat further having one or more side walls extending up from a floor of the boat around at least part of a protected area, wherein the protected area is configured to accommodate occupants of the boat during normal use of the boat, the cover assembly comprising:

a flexible cover;

a support frame configured to pull the flexible cover taut, and to support the flexible cover above the boat;

the support frame also configured to allow the flexible cover to be moved between a raised position and a lowered position, wherein, in the lowered position, the flexible cover provides a mooring cover for at least a substantial portion of the protected area, and in the raised position, the cover is suspended above the floor sufficiently far so that occupants of the boat can move about the protected area and under the cover;

the support frame including one or more elongated laterally rigid support members positioned along each of two lateral sides of the boat, each of the one or more elongated laterally rigid support members are part of, or fixed relative to, the support frame in both the raised position and lowered position, and extend to a rotatable coupling that is configured to be positioned at a fixed location along the length of the boat, wherein each of the one or more elongated laterally rigid support members are configured to rotate about a rotation axis and remain laterally rigid when the flexible cover is moved between the raised position and the lowered position; and the support frame is further configured such that a front and/or rear end of the flexible cover is movable in a lengthwise direction to change the overall length of the support frame when moved between an extended position and a retracted position, and wherein the support frame does not pull at least part of the flexible cover taut when in the retracted position that is pulled taut by the support frame when in the extended position.

14. The cover assembly of claim 13 wherein the flexible cover is made substantially from canvas.

15. The cover assembly of claim 13 wherein the flexible cover is made substantially from a flexible plastic.

16. The cover assembly of claim 13 wherein one of the elongated members is at least partially secured relative to the flexible cover via one or more pockets provided by the flexible cover.

17. A cover assembly for a boat having a passenger well defined by one or more side walls and a floor situated below a top end of the one or more side walls, wherein the passenger well is configured to accommodate occupants of the boat during normal use of the boat, the cover assembly comprising:

a flexible cover;

a support frame comprising a number of articulating elongated bars that support the flexible cover above the boat, and when articulated, the articulating elongated bars move the flexible cover between a raised position and a towered position, wherein, in the lowered position, the flexible cover provides a mooring cover for a substantial portion of the passenge well, and in the raised position, the flexible cover is suspended above the boat sufficiently far so that occupants of the boat can move about the passenger well and under the flexible cover, the support frame being configured such that at least one of the articulating elongated bars provides tension to the flexible cover to pull at least a substantial part of the flexible cover taut in both the raised position and the lowered position.

18. The cover assembly of claim 17 wherein at least a substantial portion of the flexible cover is made from canvas.

19. The cover assembly of claim 17 wherein at least a substantial nortion of the flexible cover is made from a flexible plastic.

20. The cover assembly of claim 17 wherein one of the articulating elongated bars is secured, at least in part, relative to the flexible cover via one or more pockets provided by the flexible cover.

21. The cover assembly of claim 17 wherein the support frame is configured such that a front and/or rear end of the flexible cover is retractable in a lengthwise direction from an extended position to a retracted position, wherein in the retracted position, the front and/or rear end of the cover is moved in a lengthwise direction relative to the extended position.

22. A cover system for a boat having a protected area, wherein the protected area is configured to accommodate occupants of the boat during normal use of the boat, the cover system comprising:

a cover having a pocket with a pocket width and a pocket length, wherein the pocket length extends in a transverse direction across the cover;

a support frame coupled to the boat for supporting at least part of the cover above the boat, the support frame having a pivoting support member pivotally secured relative to the boat, the support frame configured to allow the cover to be moved between a raised position and a lowered position, wherein, in the lowered position, the cover provides a cover for the protected area, and in the raised position, the cover is suspended above the boat sufficiently far so that occupants of the boat can move about there under;

the support frame including at least one cover support member that extends transversely across the cover, through the pocket of the cover and along the pocket length, the pocket width being substantially greater than a corresponding outer dimension of the at least one cover support member; and wherein when the support frame moves the cover between the raised position and the lowered position, the at least one cover support member slides relative to the cover within the pocket along at least part of the pocket width.

23. The cover system of claim 22 wherein the at least one cover support member slides relative to the cover along at least a majority of the pocket width.

24. The cover system of claim 23 wherein the pocket width is greater than 3 times the corresponding outer dimension of the at least one cover support member.

25. A cover system for a boat having a passenger well defined by two lateral side walls and a floor situated below a top end of the two lateral side walls, wherein the passenger well is configured to accommodate occupants of the boat during normal use of the boat, the passenger well defined by the two lateral side walls including a control console for driving the boat, the cover system comprising:

a flexible cover formed from a canvas or fabric material, the flexible cover having a front edge, a rear edge and two lateral side edges;

a support frame configured to pull the flexible cover taut, and to support the flexible cover above the boat;

the support frame further configured to allow the flexible cover to be moved between a raised position and a lowered position, wherein, in the lowered position, the flexible cover provides a mooring cover for at least a substantial portion of the passenger well, whereby the lateral side edges of the flexible cover are lowered to be adjacent the top end of at least part of the two lateral side walls such that windswept rain is prevented or substantially prevented from entering between the flexible cover and the corresponding part of the lateral side walls, and in the raised position, the flexible cover is suspended above the boat sufficiently far so that occupants of the boat can move about the protected area and under at least part of the flexible cover; and the support frame including one or more articulating support members along each of two lateral sides of the boat, each of the one or more articulating support members has a first end that is part of, or fixed to, the support frame in both the raised position and lowered position the one or more articulating support members are structured such that, when articulated, the articulating support members direct and move the flexible cover along a defined path between the raised position and the lowered position.

26. The cover system of claim 25 wherein, in the raised position, a first part of the flexible cover is in a horizontal or substantially horizontal orientation, and a second part of the flexible cover is in an articulated position that is not in a horizontal or substantially horizontal orientation.

27. The cover system of claim 26 wherein the second part of the flexible cover is in an articulated position that is in a vertical or substantially vertical orientation.

28. The cover system of claim 26 wherein the second part of the cover articulates to the articulated position as the flexible cover is moved from the lowered position to the raised position.

29. The cover system of claim 25, wherein the support frame is further configured such that the front and/or rear edge of the flexible cover is movable in a lengthwise direction to change the overall length of the support frame and flexible cover when moved between an extended position and a retracted position, and wherein the support frame does not pull at least part of the flexible cover taut when in the retracted position that is pulled taut by the support frame when in the extended position.

* * * * *

UNITED STATES PATENT AND TRADEMARK OFFICE

CERTIFICATE OF CORRECTION

PATENT NO. : 7,520,240 B2
APPLICATION NO. : 10/905818
DATED : April 21, 2009
INVENTOR(S) : Brian N. Tufte It is certified that error appears in the above-identified patent and that said Letters Patent is hereby corrected as shown below:

Column 18
Line 57, delete “towered”, and insert therefor --lowered--.

Line 59, delete “passenge”, and insert therefor --passenger--.

Column 19
Line 4, delete “nortion”, and insert therefor --portion--.

Signed and Sealed this

Twenty-eighth Day of July, 2009

JOHN DOLL
*Acting Director of the United States Patent and Trademark Office*